US006303282B1

(12) United States Patent
Naruse et al.

(10) Patent No.: US 6,303,282 B1
(45) Date of Patent: Oct. 16, 2001

(54) HEAT DEVELOPABLE COLOR PHOTOGRAPHIC PHOTOSENSITIVE MATERIAL

(75) Inventors: Hideaki Naruse; Toshio Kawagishi; Takeshi Shibata, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/461,773

(22) Filed: Dec. 15, 1999

(30) Foreign Application Priority Data

Dec. 16, 1998 (JP) ..... 10-358210

(51) Int. Cl.[7] ..... G03C 7/392; G03C 7/26; G03C 1/42; G03C 8/10; G03C 8/40

(52) U.S. Cl. ..... 430/559; 430/203; 430/214; 430/218; 430/351; 430/380; 430/551; 430/565

(58) Field of Search ..... 430/203, 214, 430/218, 565, 380, 351, 551, 559

(56) References Cited

U.S. PATENT DOCUMENTS

| | | | | |
|---|---|---|---|---|
| 2,998,314 | * | 8/1961 | Poschel | 430/555 |
| 3,876,428 | * | 4/1975 | Murin et al. | 430/565 |
| 5,139,919 | | 8/1992 | Taguchi et al. | 430/203 |
| 5,756,269 | * | 5/1998 | Ishikawa et al. | 430/203 |
| 6,130,022 | * | 10/2000 | Naruse | 430/203 |
| 6,177,227 | * | 1/2001 | Nakagawa | 430/218 |

FOREIGN PATENT DOCUMENTS

19629142A1 1/1998 (DE) .

* cited by examiner

*Primary Examiner*—Richard L. Schilling
(74) *Attorney, Agent, or Firm*—Birch, Stewart, Kolasch & Birch, LLP

(57) ABSTRACT

The present invention discloses a color photographic photosensitive material for heat development, which material is characterized in that the color photographic photosensitive material produces superior discrimination with reduced color muddiness in rapid processing. The color photographic photosensitive material for heat development of the present invention comprises a support having thereon a photosensitive silver halide, a binder, a dye-releasable compound, a compound represented by the general formula (I) or (II), and a compound represented by the general formula (III) or (IV).

(I)

(II)

(III)

(IV)

19 Claims, No Drawings

HEAT DEVELOPABLE COLOR PHOTOGRAPHIC PHOTOSENSITIVE MATERIAL

BACKGROUND OF THE INVENTION

1. Field of the Invention

The present invention relates to a color photographic photosensitive material for heat development.

2. Description of the Related Art

The technology for forming images by heat development of a silver halide photographic photosensitive material is well known. This technique is described, for example, in "Fundamentals of Photographic Engineering—Non-silver Salt Photography Section", pp.242–255, Corona Co., Ltd., 1982, U.S. Pat. No. 4,500,626, and others.

Because of its superior photographic properties such as its sensitivity and gradation in comparison with electrophotography and diazophotography, photography which uses heat developed photosensitive materials using silver halide is conventionally widely known. A variety of methods have been proposed for obtaining color images by heat development of a silver halide photosensitive material. One of these methods is a color development process in which color images are formed by the coupling reaction between the oxidized form of a developing agent and a coupler. As to the developing agents and the couplers usable in this color development system, there have been made various proposals. For example, U.S. Pat. No. 3,531,256 proposes a combination of a reducing agent based on a p-phenylenediamine and a phenol or an active methylene coupler; U.S. Pat. No. 3,761,270 proposes a reducing agent based on a p-aminophenol; and U.S. Pat. No. 4,021,240 proposes a combination of a reducing agent based on a sulfonamide and a 4-equivalent coupler.

However, in the conventional color development systems described above, since silver halides remain in undeveloped regions even after processing, color is sometimes formed in the undeveloped regions during printout or storage. In addition, since the reduced silver and the color images are present simultaneously in exposed regions, color muddiness is sometimes caused. Therefore, there is a need for improvement of these prior art color development systems.

In order to solve these problems, there has been proposed a dye transfer system in which diffusive dyes are formed by heat development and the dyes thus formed are then transferred to an image receiving layer. Among the modes of photosensitive materials for diffusion transfer heat development according to the above-described dye transfer system, there are a mode in which a photosensitive material has on the substrate thereof an image receiving layer capable of receiving dyes so that the photosensitive material has the ability to carry out the two functions (i.e., the dye-diffusing function and the dye-receiving function): and a mode in which a photosensitive material has no image receiving layer and is used in combination with an image receiving material having an image receiving layer provided on the substrate thereof.

When the dye transfer process is utilized in a color photographic photosensitive material intended for heat development, in order to obtain dye images having a high color purity, it is desirable to carry out the diffusion transfer of the dyes to the image receiving layer of the image receiving material simultaneously with the formation of the diffusive dyes or after the formation of the diffusive dyes in the color development of the photosensitive material.

On the other hand, there has been proposed a method in which diffusive dyes are released or formed image-wise in heat development so that the diffusive dyes are transferred to a fixing element. This method uses a dye-releasable (donative) compound which releases or forms a diffusive dye. According to this method, both a negative color image and a positive color image can be obtained by changing the type of dye-releasable compound or silver halide used. More details are described, for example, in U.S. Pat. Nos. 4,500,625, 4,483,914, 4,503,137, and 4,559,290, Japanese Patent Application Laid-Open (JP-A) Nos. 58-149,046, 60-133,449, 59-218,443, and 61-238,056, European Patent Application Laid-Open No. 220,746A2, Journal of Technical Disclosure No.87-6,199, and European Patent Application Laid-Open No. 210,660A2. The methods described in these publications, however, are associated with a problem that the sensitivity of the photosensitive material is reduced because a dye, which is colored in advance, is contained as a partial structure of the dye-releasable substance. In order to solve this problem, what is needed is the realization of a method in which a colorless coupler is present prior to development and the development causes a reaction between the colorless coupler and a developing agent to form a dye which is thereafter diffused.

Also proposed is a method in which diffusive dyes are produced by a coupling system so that an image is formed. For example, Japanese Patent Application Publication (JP-B) No. 63-36,487, and JP-A Nos. 5-224,381 and 6-83,005 disclose a photosensitive material for heat development which contains a precursor of a color developing agent capable of releasing p-phenylenediamine and a coupler; JP-A No. 59-111,148 discloses a combination of a ureidoaniline-based reducing agent and an active methylene-based coupler; JP-A No. 58-149,047 discloses a photosensitive material utilizing as a leaving group a coupler having a polymeric chain and releasing a diffusive dye in color development; and JP-A No. 9-152,705 discloses a technique in which a dye is formed/released by a combination of a carbamoylhydrazine-based developing agent and an active methylene-based coupler. However, the image forming methods utilizing a color developing agent or a precursor thereof and a dye-releasable substance described in these publications are associated with problems such as significant dependence on the processing time and therefore need improvements from the standpoint of speeding up the processing.

As a measure to solve these problems, for example, JP-A No. 1-138,556 discloses a method in which a hydrophilic reducing agent serving as an auxiliary developing agent is used together with a lipophilic reducing agent to allow electron transfer therebetween so that the development is speeded up. However, although this technique speeds up the development, it presents a serious problem that color muddiness is caused because, in some cases, the oxidized form of the auxiliary developing agent diffuses at the time of development into regions other than the color developing layer, which has been exposed, and thus develops color in these regions. To overcome this problem, as an ordinary measure, the reducing agent is immobilized between a color developing layer and another color developing layer. However, this measure, if utilized in the above-described processing methods, provides insufficient effects and, in addition, presents a problem that it seriously degrades the minimum density (D min) of the photosensitive material. From the foregoing, it will be appreciated that what is needed in the art is the advent of a technology which enables speedup in development while causing little or no color muddiness.

SUMMARY OF THE INVENTION

The object of the present invention is to provide a color photographic photosensitive material for heat development, characterized in that the color photosensitive material produces superior discrimination with reduced color muddiness by rapid processing.

The object of the present invention can be achieved by the following method.

A color photographic photosensitive material for heat development, said photosensitive material comprising a substrate having thereon at least a photosensitive silver halide, a binder, a dye-releasable compound, a compound represented by the general formula (I) or (II), and a compound represented by the general formula (III) or (IV):

General formula (I)

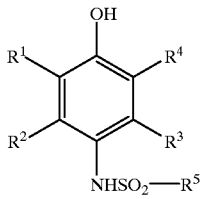

General formula (II)

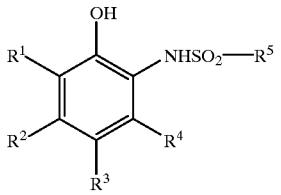

In the formulae, $R^1$ to $R^4$ each represent a hydrogen atom, a halogen atom, a cyano group, or a group selected from the group consisting of an alkyl group, an aryl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamide group, an arylcarbonamide group, an alkylsulfonamide group, an arylsulfonamide group, an alkylcarbonyloxy group, an arylcarbonyloxy group, a carbamoyl group, an alkylcarbamoyl group, an arylcarbonyl group, an alkoxycarbonyl group, an aryloxycarbonyl group, a sulfamoyl group, an alkylsulfonyl group, an arylsulfonyl group, an ureido group, and a urethane group, with the proviso that these groups have 4 or less carbon atoms or an I/O value of 1 or more. If $R^1$ and $R^2$ as well as $R^3$ and $R^4$ are each a group other than a hydrogen atom, $R^1$ and $R^2$ as well as $R^3$ and $R^4$ may join together to form respective rings within the above-described range of I/O values. $R^5$ represents a group selected from the group consisting of an alkyl group, an aryl group, a heterocyclic ring group, an alkylamino group, an arylamino group, and a heterocyclic amino group.

General formula (III)

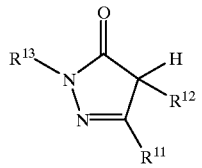

In the formula, $R^{11}$ represents a hydrogen atom or a substituent group; $R^{12}$ represents a group selected from the group consisting of an alkyl group, an alkenyl group, an alkynyl group, an aryl group, a heterocyclic group, an alkoxycarbonyl group, an aryloxycarbonyl group, and a carbamoyl group; and $R^{13}$ represents a group selected from the group consisting of a hydrogen atom, an alkyl group, an alkenyl group, an alkynyl group, an aryl group, and a heterocyclic group.

General formula (IV)

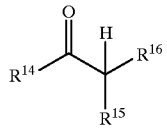

In the formula, $R^{14}$represents a group selected from the group consisting of an alkyl group, an alkenyl group, an alkynyl group, an aryl group, a heterocyclic group, an alkoxy group, an aryloxy group, a heterocycloxy group, an amino group, and an anilino group; $R^{15}$ represents a group selected from the group consisting of an alkoxycarbonyl group, an aryloxycarbonyl group, and a carbamoyl group; and $R^{16}$ represents a group selected from the group consisting of an alkyl group, an alkenyl group, an alkynyl group, an aryl group, and a heterocyclic group. $R^{14}$ and $R^{16}$ may join together to form a ring.

DESCRIPTION OF THE PREFERRED EMBODIMENTS

Details of the compounds represented by the general formula (I) or (II) are given below.

The compounds represented by the general formula (I) or (II) are reducing agents collectively known as sulfonamide phenol, which is used as a reducing agent for silver development in the present invention. In the formula, $R^5$ is most preferably an aryl group represented by the following general formula (V). $R^1$ to $R^4$ in the general formulae (I) and (II) as well as $R^6$ to $R^{10}$ in the general formula (V) represent, respectively, a hydrogen atom, a halogen atom, a cyano group, or a substituent group having 4 or less carbon atoms or an I/O value of 1 or more. Preferably, the I/O value is between 1 and 10.

General formula (V)

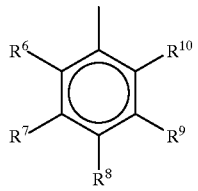

An I/O value is a parameter indicating the degree of lipophilicity/hydrophilicity of a compound or substituent group, and its details are described in "Conceptual Diagram of Organicity" (Yuki Gainenzu) (by Y. Kohda, Sankyo Publishing Co., Ltd., 1984). I stands for inorganicity while O stands for organicity such that a larger I/O value indicates stronger inorganicity. Specific examples of the I/O values are given below. As typical examples, the I value is 200 for —NHCO— group; 240 for —$NHSO_2$— group; and 60 for —COO— group. For example, in the case of —$NHCOCO_5H_{11}$, the number of carbon atoms is 6 and therefore the O value is 20×6=120. Since the I value is 200, I/O is nearly equal to 1.67, which is more than 1. The compounds in the present invention are characterized in that these compounds are substituted with substituent groups each having an I/O value of 1 or more or carbon atoms of 4 or less in number and in that these compounds are hydrophilic. Specific examples of $R^1$ to $R^4$ as well as $R^6$ to $R^{10}$ as substituent groups include the following groups. A halogen atom (e.g., a chlorine or bromine atom), an alkyl group (e.g., a methyl, ethyl, isopropyl, n-butyl, or t-butyl group), an aryl group (e.g., a 3-methanesulfonylamino phenyl group), an alkylcarbonamide group (e.g., an acetylamino, propionylamino, or butyloylamino group), an arylcarbonamide group (e.g., a benzoylamino group), an alkylsulfonamide group (e.g., a methanesulfonylamino or ethanesulfonylamino group), an arylsulfonamide group (e.g., a benzenesulfonylamino or toluenesulfonylamino group), an alkoxy group(e.g., a methoxy or ethoxy group), an aryloxy group (e.g., a4-methanesulfonyl aminophenoxy group), an alkylthio group (e.g., a methylthio, ethylthio, or butylthio group), an arylthio group (e.g., a 4-methanesulfonyl aminophenylthio group), an alkylcarbamoyl group (e.g., a methylcarbamoyl, dimethylcarbamoyl, ethylcarbamoyl, diethylcarbamoyl, dibutylcarbamoyl, piperidinocarbamoyl, or morpholinocarbamoyl group), an arylcarbonyl group (e.g., a phenylcarbamoyl, methylphenylcarbamoyl ethylphenylcarbamoyl, or benzylphenylcarbamoyl group), a carbamoyl group, an alkylsulfonyl group (e.g., a methylsulfonyl, dimethylsulfamoyl, ethylsulfamoyl, diethylsulfamoyl, dibutylsulfamoyl, piperidinosulfamoyl, or morpholinosulfamoyl group), an arylsulfamoyl group (e.g., a phenylsulfamoyl, methylphenylsulfamoyl, ethylphenylsulfamoyl, or benzylphenylsulfamoyl), a sulfamoyl group, a cyano group, an alkylsulfonyl group (e.g., a methanesulfonyl or ethanesulfonyl group), an arylsulfonyl group (e.g., a phenylsulfonyl, 4-chlorophenylsulfonyl, or p-toluenesulfonyl group), an alkoxycarbonyl group (e.g., a methoxycarbonyl, ethoxycarbonyl, or butoxycarbonyl group), an aryloxycarbonyl group (e.g., a phenoxycarbonyl group), an alkylcarbonyl group (e.g., an acetyl, propionyl, or butyloyl group), an arylcarbonyl group (e.g., a benzoyl or alkylbenzoyl group), and an acyloxy group (e.g., anacetyloxy, propionyloxy, or butyloyloxy group). $R^5$ in the formulae (I) and (II) is preferably a group represented by the general formula (V). The substituent groups $R^6$ and/or $R^{10}$ in the general formula (V) are preferably substituent groups other than a hydrogen atom. Furthermore, the substituent groups $R^2$ and/or $R^4$ in the general formula (I) as well as $R^4$ in the general formula (II) are preferably substituent groups other than a hydrogen atom. In the case where $R^1$ and $R^2$ $R^3$ and $R^4$, $R^6$ and $R^7$, $R^7$ and $R^8$, $R^8$ and $R^9$, and $R^9$ and $R^{10}$ are each a substituent group other than a hydrogen atom, the respective pairs may independently form rings within the condition of the I/O value.

The compounds represented by the general formulae (I) or (II) can be synthesized by combining stepwise the methods widely known in the field of organic synthetic chemistry. For the purpose of illustration of the synthetic schemes, examples of the stepwise synthetic methods are given below.

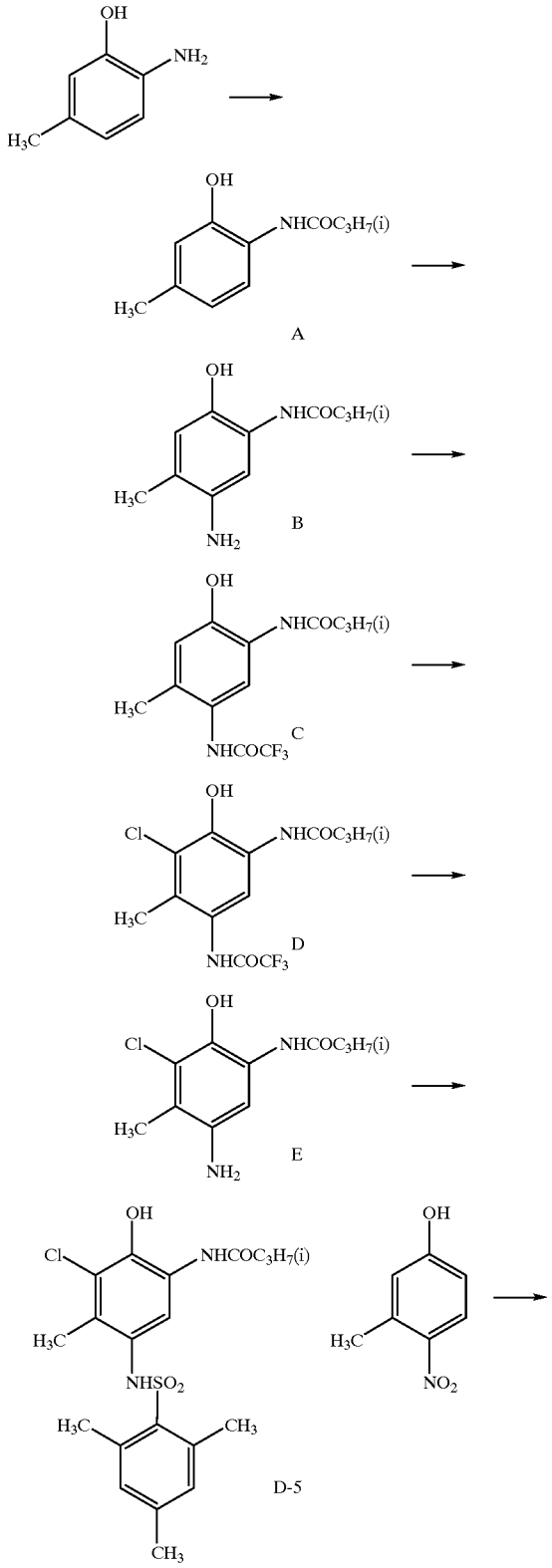

-continued

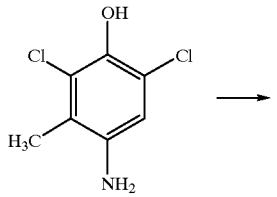

F

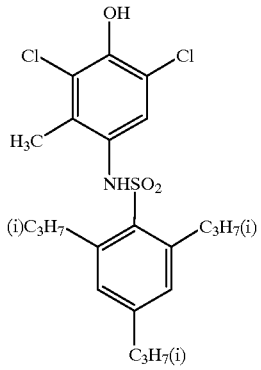

D-9

(Synthesis of the Illustrative Compound D-5)

(1) Synthesis of the Compound A

A 5-L, three-neck flask fitted with a condenser, thermometer, dropping funnel, and mechanical agitator was charged with 766 g (5 mol) of 6-amino-m-cresol and 2,000 mL of acetonitrile. The reaction mixture was stirred at room temperature. At this time, the reaction mixture was in a state of heterogeneous slurry. Then, 791 g (5 mol) of isobutyric acid anhydride was added over a period of 30 minutes. The addition of the acid caused the temperature of the reaction mixture to gradually rise and the final temperature was 60° C., at which temperature the reaction mixture became homogeneous. When the rise in temperature ceased, the deposition of crystals of the reaction product started in the flask. The agitation of the contents of the flask was continued for 1 hour. After that, the contents were poured into 15 L of a 10% aqueous solution of sodium chloride and the deposited crystals were collected by filtration under a reduced pressure using a Nutsche. The crystals were washed with 2 L of distilled water and then dried. The crystals were so pure that they could be used in the subsequent step without further purification thereof. In this way, 928 g of the crystals of the compound A was obtained (in 96% yield).

(2) Synthesis of the Compound B

A 10-L beaker was charged with 193 g (1 mol) of the compound A and to this, an aqueous solution prepared by dissolving 500 mL of methanol and 120 g (3 mol) of sodium hydroxide in 500 mL of water. The resulting solution was kept at 0° C. while being stirred. Meanwhile, 216 g (1.25 mol) of sulfanilic acid was dissolved completely in an aqueous solution prepared by dissolving 50 g of sodium hydroxide in 400 mL of water. Then, 300 mL of concentrated hydrochloric acid was added to the solution to thereby prepare a liquid in a state of slurry. While this liquid in a state of slurry was kept at a temperature of 0° C. or below and stirred vigorously, an aqueous solution prepared by dissolving 93 g (1.35 mol) of sodium nitrite in 200 mL of water was added gradually to the liquid. In this way, a diazonium salt was formed. In this case, the reaction was performed by appropriately adding ice so as to keep the temperature at 0° C. or below. The diazonium salt thus formed was added gradually to the solution of the compound A which had been continuously stirred. In this case, too, the reaction was performed by appropriately adding ice so as to keep the temperature at 0° C. or below. With the addition, the red color of an azo dye appeared in the solution of the compound A. After the completion of the addition, the reaction was continued for 30 minutes at 0° C. or below until the disappearance of the starting materials was confirmed. At this stage, 750 g (4.5 mol) of sodium hydrosulfite in a state of powder was added. The reaction mixture was heated to 50° C. The heating caused the reduction of the azo group with vigorous foaming. At the time when the foaming ceased and the reaction mixture was decolorized and became a yellowish transparent solution, the solution was cooled gradually to 10° C. At the point where the cooling started, the deposition of crystals gradually started. The deposited crystals were collected by filtration. The crude crystals were purified by recrystallization from a methanol/water solvent mixture. In this way, 162 g of the crystals of the compound B was obtained (in 78% yield).

(3) Synthesis of the Compound C

A 5-L, three-neck flask fitted with a condenser, thermometer, dropping funnel, and mechanical agitator was charged with 833 g (4 mol) of the compound B and 2,000 mL of acetonitrile. The reaction mixture was stirred at room temperature. At this time, the reaction mixture was in a state of heterogeneous slurry. Then, 840 g (4 mol) of trifluoroacetic acid anhydride was added dropwise over a period of 30 minutes. The addition of the acid caused the temperature of the reaction mixture to gradually rise. The reaction mixture was cooled in an ice bath in an appropriate manner so that the final temperature was 45° C. After the addition, the reaction mixture became homogeneous. When the rise in temperature ceased, the deposition of crystals of the reaction product started in the flask. The agitation of the contents of the flask was continued for 1 hour. After that, the contents were poured into 15 L of a 10% aqueous solution of sodium chloride and the deposited crystals were collected by filtration under a reduced pressure using a Nutsche. The crystals were washed with 2L of distilled water and then dried. The crystals were so pure that they could be used in the subsequent step without further purification thereof. In this way, 1,132 g of the crystals of the compound C was obtained (in 93% yield).

(4) Synthesis of the Compound D

A 5-L, three-neck flask fitted with a condenser, thermometer, dropping funnel, and mechanical agitator was charged with 913 g (3 mol) of the compound C and 2,500 mL of dichloromethane. The reaction mixture was stirred at room temperature. At this time, the reaction mixture was in a state of heterogeneous slurry. Then, 540 g (4 mol) of sulfuryl chloride was added (dropwise) over a period of 30 minutes. The addition caused the temperature of the reaction mixture to gradually rise and refluxing began as gases evolved. After the completion of the addition, the reaction was continued for 2 hours in refluxing conditions, until the gas evolution ceased at this point(the completion of gas-generation). and the reaction mixture was still in a heterogeneous state. The agitation of the contents of the flask was continued further for 1 hour. After that, the contents were cooled to room temperature and poured into 10 L of n-hexane. The deposited crystals were collected by filtration under a reduced pressure using a Nutsche. The crystals were washed with 2 L of n-hexane and then dried. The crystals were so pure that they could be used in the subsequent step without further purification thereof. In this way, 904 g of the crystals of the compound D was obtained (in 89% yield)

(5) Synthesis of the Compound D

A 3-L, three-neck flask fitted with a condenser, thermometer, dropping funnel, tube for the introduction of nitrogen, and mechanical agitator was charged with 224 of potassium hydroxide and 1,200 mL of water. The potassium hydroxide was completely dissolved in the water. Then, while introducing nitrogen into the flask, 678 g (2 mol) of the compound D in a state of powder was added. After the addition, the temperature of the reaction mixture was raised to 60° C. At this time, the reaction mixture changed from a heterogeneous slurry into a homogeneous solution. The agitation of the solution was continued for 2 hours. The temperature of the solution was then lowered to room temperature. After that, 200 mL of acetic acid was added to the solution. Since the addition caused the deposition of crystals, the deposited crystals were collected by filtration under a reduced pressure using a Nutsche. The crystals were washed with cold distilled water and thereafter purified by recrystallization from a methanol/water solvent mixture. In this way, 403 g of the crystals of the compound E was obtained (in 83% yield).

(6) Synthesis of the Illustrative Compound D-5

A 5-L, three-neck flask fitted with a condenser, thermometer, dropping funnel, and mechanical agitator was charged with 971 g (4 mol) of the compound E and 2,800 mL of acetonitrile. The reaction mixture was stirred at room temperature. At this time, the reaction mixture was in a state of heterogeneous slurry. Then, 875 g (4 mol) of mesitylenesulfonyl chloride in a state of powder was added over a period of 10 minutes. The addition caused the temperature of the reaction mixture to gradually rise. The reaction mixture was cooled in an ice bath appropriately so that the final temperature was 30° C. After the addition, the reaction mixture was cooled in an ice bath until the temperature reached 15° C. or below. At this point, 324 mL (4 mol) of pyridine was added dropwise to the reaction mixture over a period of 10 minutes. After the addition, while being stirred, the reaction mixture was caused to react for 2 hours at room temperature. A little while later, crystals of the reaction product started depositing in the flask. After the reaction was completed, the contents were poured into 20 L of a 3% aqueous solution of hydrochloric acid and the deposited crystals were collected by filtration under a reduced pressure using a Nutsche. The crystals were washed with 4 L of distilled water and then dried. The crystals were purified by recrystallization from an acetonitrile/water solvent mixture. In this way, 1,564 g of the crystals of the illustrative compound D-5 was obtained (in 92% yield).

(Synthesis of the Illustrative Compound D-9)

(1) Synthesis of the Compound F

A 5-L, three-neck flask fitted with a condenser, thermometer, dropping funnel, and mechanical agitator was charged with 153 g (1 mol) of 4-nitro-m-cresol and 1,000 mL of methanol. The reaction mixture was stirred at room temperature. At this time, the reaction mixture was in a state of heterogeneous slurry. Then, 2 L of an aqueous sodium hypochlorite (having an effective chlorine content of 5%) was added dropwise to the reaction mixture exercising caution in order not to allow the temperature of the reaction mixture to exceed 50° C. With the addition, the color of the reaction mixture changed to a reddish brown color. After the completion of the addition, 500 g (3 mol) of sodium hydrosulfite in a state of powder was gradually added. The addition caused the reduction of the nitro group with vigorous foaming. At this time, caution was exercised to prevent the temperature of the reaction mixture from exceeding 60° C. and to prevent the foaming from becoming excessively vigorous. At the point where the foaming ceased and the reaction mixture was decolorized and changed into a yellowish transparent solution, the solution was cooled gradually to 10° C. Approximately at the point where the cooling started, the deposition of crystals gradually started. The deposited crystals were collected by filtration. The crude crystals were purified by recrystallization from a methanol/water solvent mixture. In this way, 142 g of the crystals of the compound F was obtained (in 74% yield).

(2) Synthesis of the illustrative Compound D-9

A 5-L, three-neck flask fitted with a condenser, thermometer, dropping funnel, and mechanical agitator was charged with 768 g (4 mol) of the compound F, 1,500 mL of acetonitrile, and 1,100 mL of N,N-dimethylacetoamide (DMAc) The reaction mixture was stirred at room temperature. At this time, the reaction mixture was in a homogeneous state. Then, 1,212 g (4 mol) of triisopropylbenzenesulfonyl chloride in a state of powder was added over a period of 10 minutes. The addition caused the temperature of the reaction mixture to gradually rise. The reaction mixture was cooled in an ice bath appropriately in order not to allow the temperature of the reaction mixture to exceed 30° C. After the addition, the reaction mixture was cooled in an ice bath to keep the temperature at 15° C. or below. At this point, 324 mL (4 mol) of pyridine was added dropwise to the reaction mixture over a period of 10 minutes. After the addition, while being stirred, the reaction mixture was caused to react for 2 hours at room temperature. After the reaction was completed, the contents were poured into 20 L of a 3% aqueous solution of hydrochloric acid and the deposited crystals were collected by filtration under a reduced pressure using a Nutsche. The crystals were washed with 4 L of distilled water and then dried. The crystals were purified by recrystallization from an methanol/water solvent mixture. In this way, 1,669 g of the crystals of the illustrative compound D-9 was obtained (in 91% yield).

The specific examples of the compounds represented by the general formula (I) or (II) are given below. However, it should be noted that the present invention is not limited by these examples.

D-1
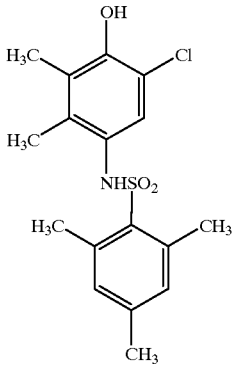
D-2
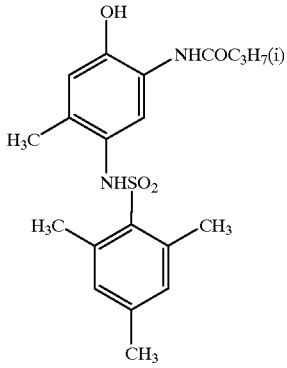
D-3
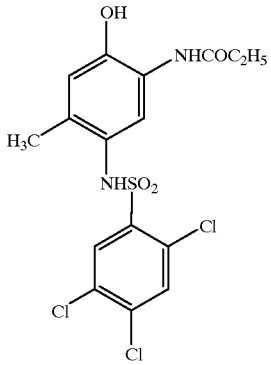
D-4
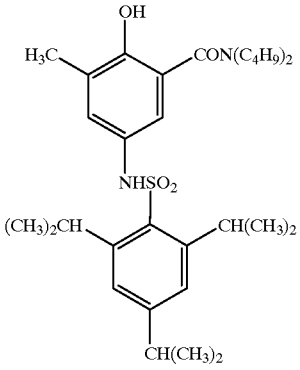
-continued
D-5
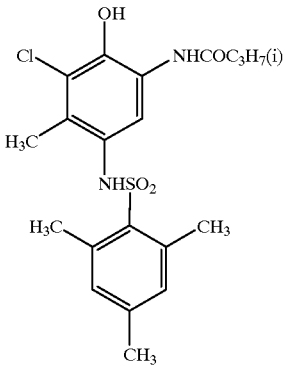
D-6
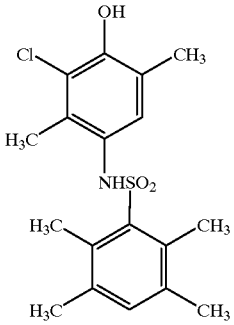
D-7
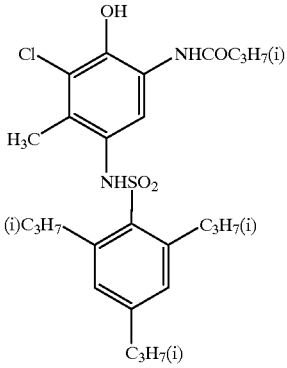

-continued
D-8
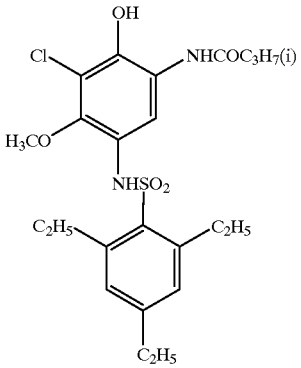
D-9
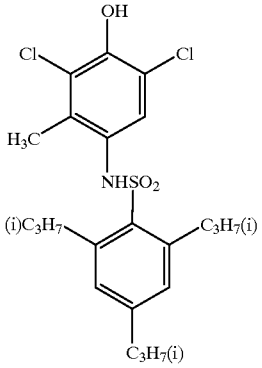
D-10
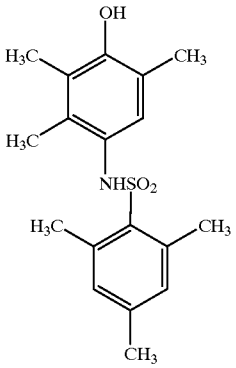
D-11
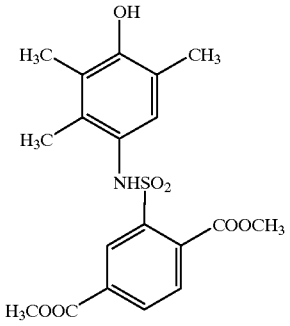
-continued
D-12
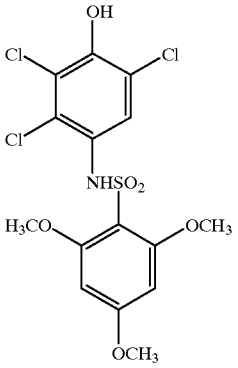
D-13
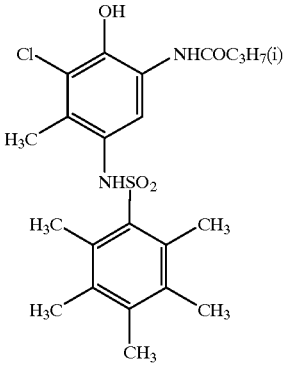
D-14
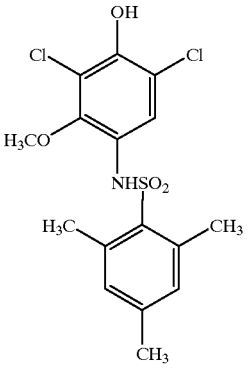
D-15
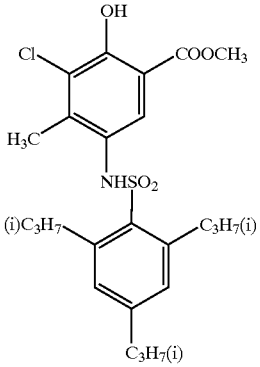

-continued
D-16
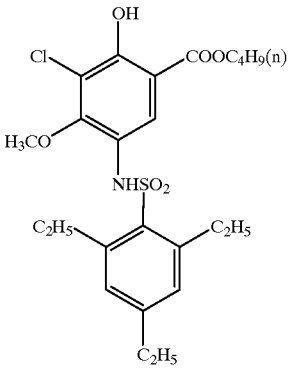
D-17
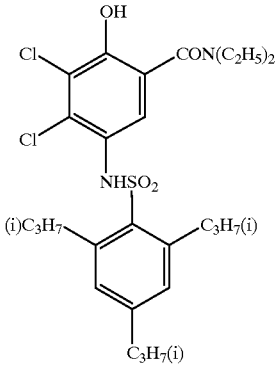
D-18
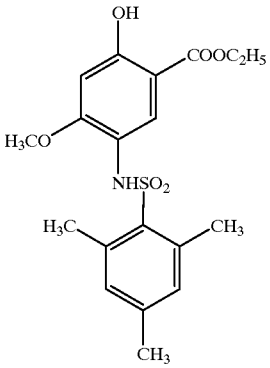
D-19
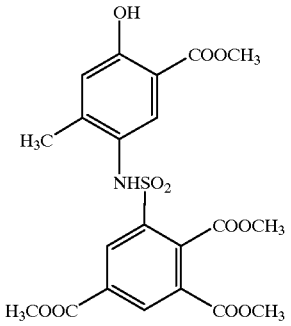
-continued
D-20
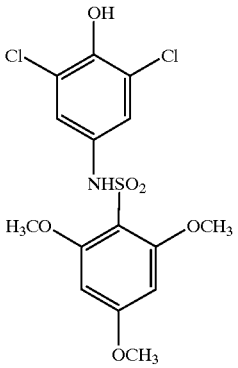
D-21
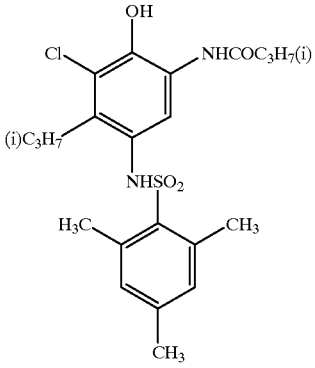
D-22
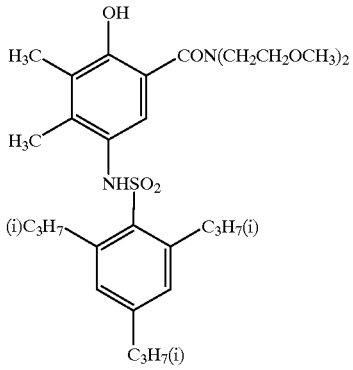
D-23
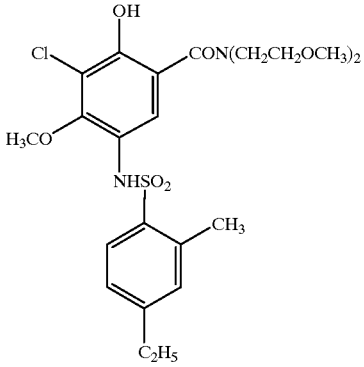

-continued
D-24
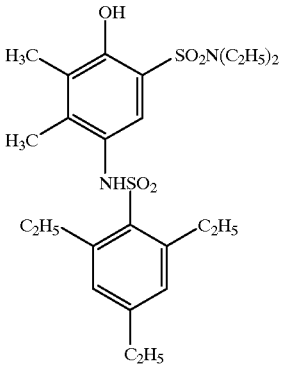
D-25
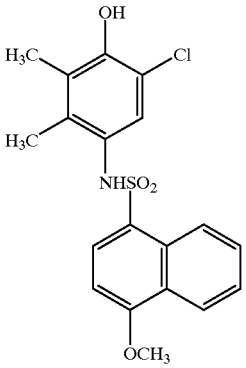
D-26
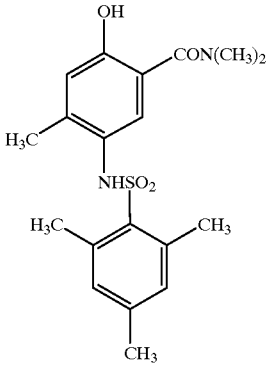
D-27
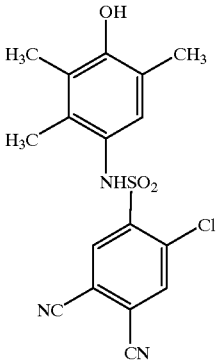
-continued
D-28
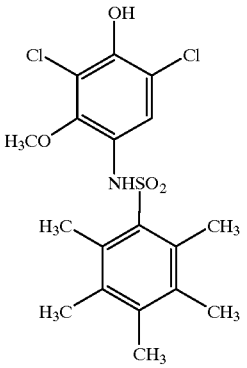
D-29
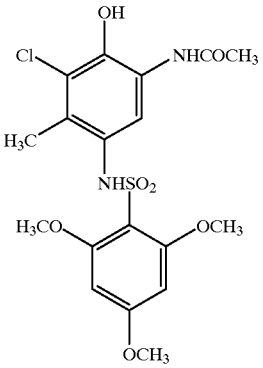
D-30
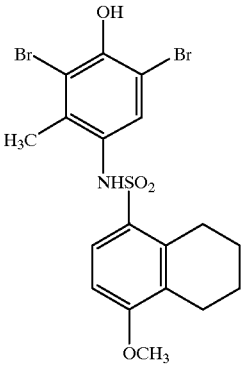
D-31
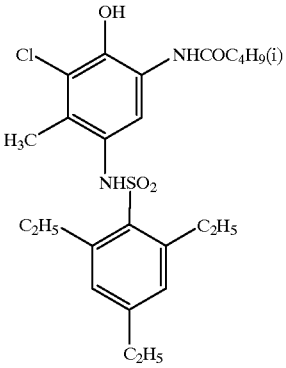

-continued
D-32
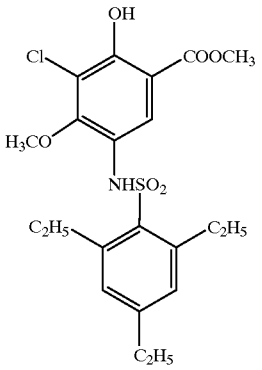
D-33
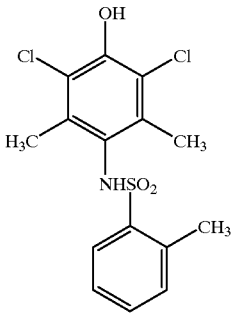
D-34
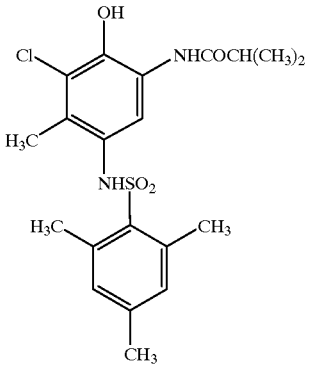
D-35
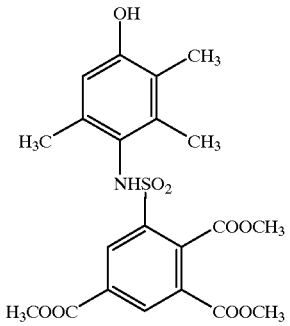
-continued
D-36
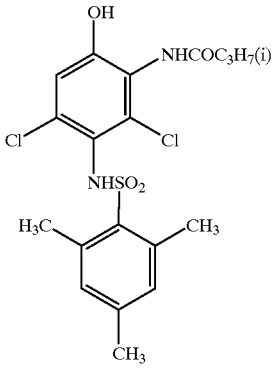
D-37
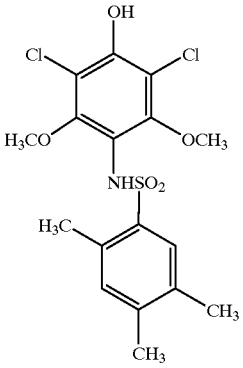
D-38
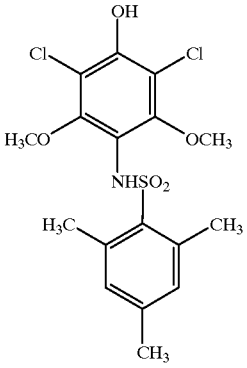
D-39
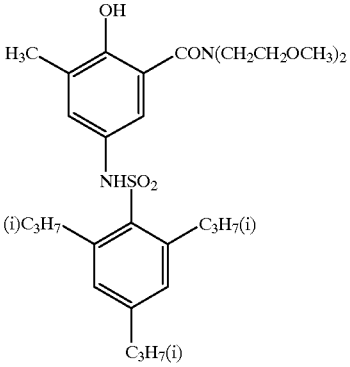

-continued
D-40
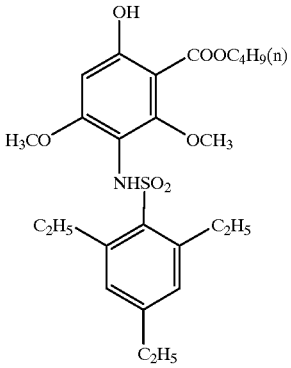
D-41
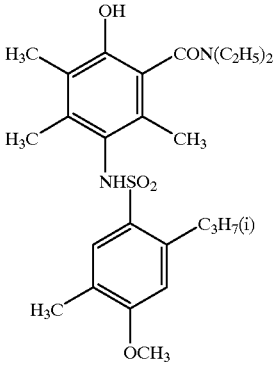
D-42
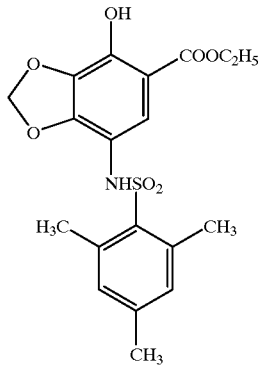
D-43
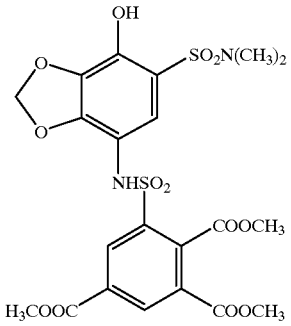
-continued
D-44
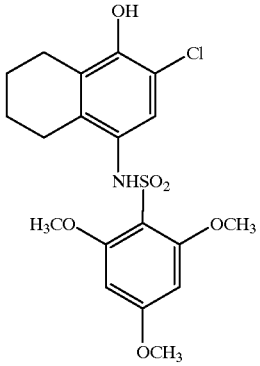
D-45
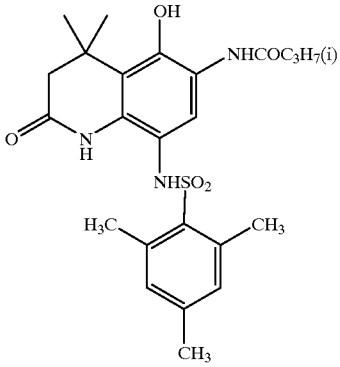
D-46
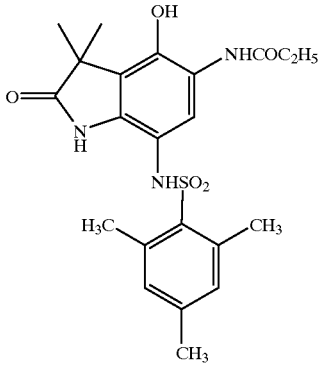
D-47
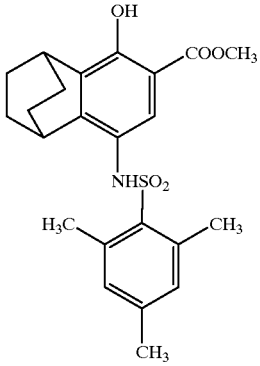

-continued
D-48
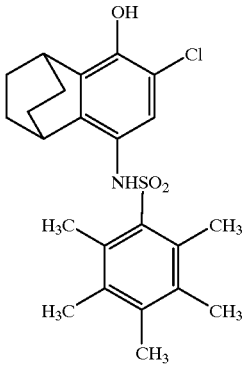
D-49
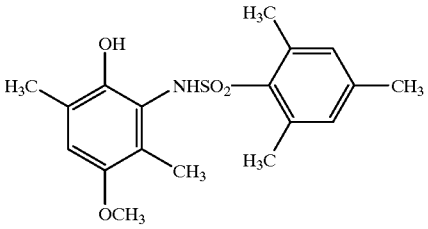
D-50
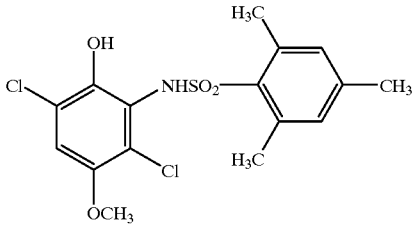
D-51
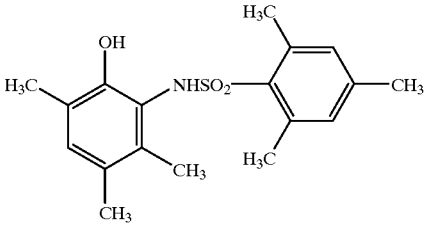
D-52
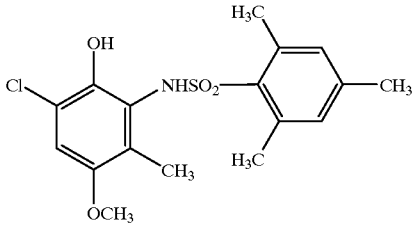
D-53
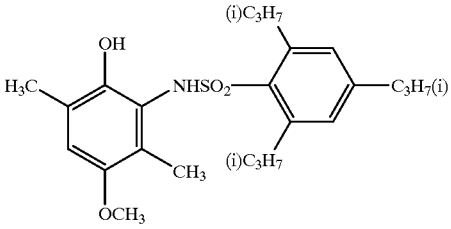
-continued
D-54
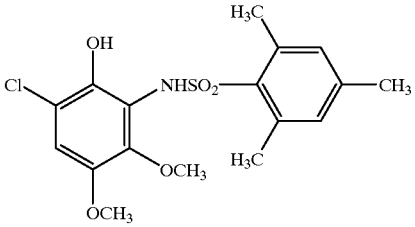
D-55
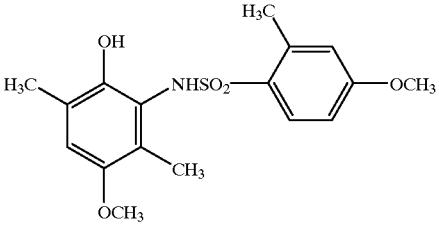
D-56
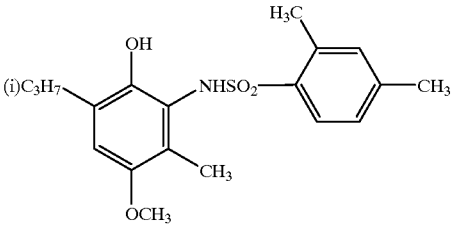
D-57
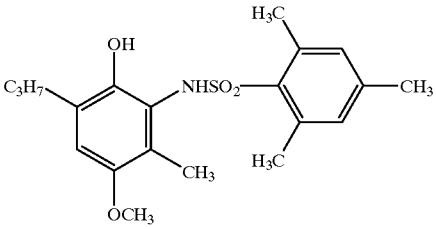
D-58
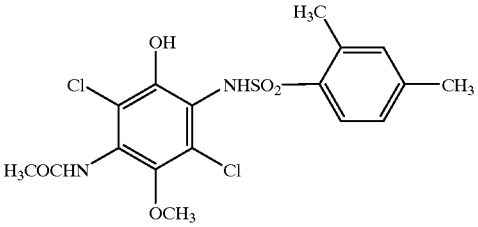
D-59
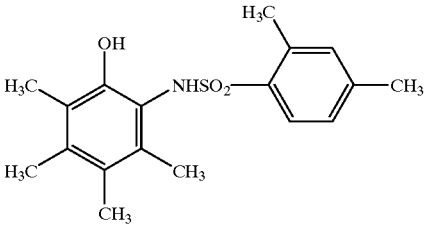

-continued

D-60

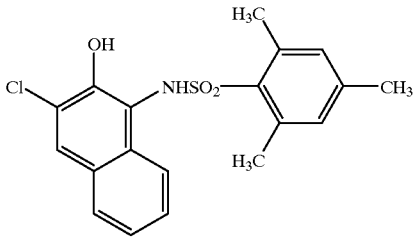

D-61

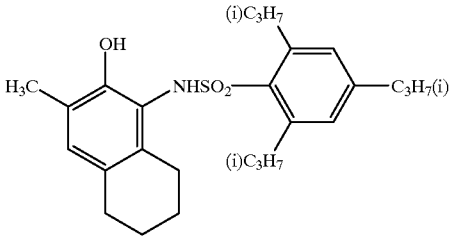

D-62

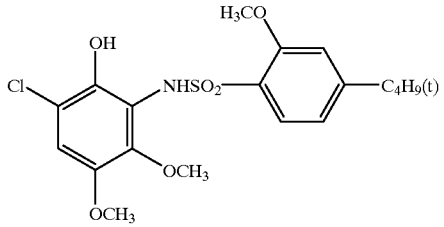

D-63

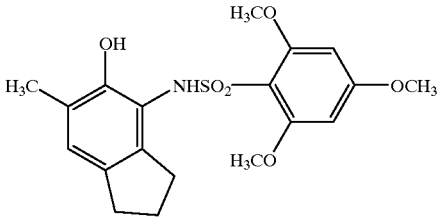

D-64

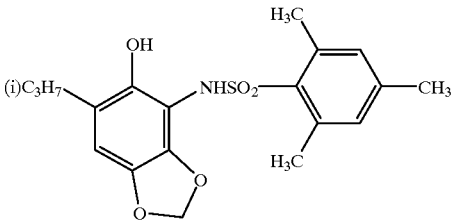

The amounts to be used of these compounds are preferably 10 to 200 mole %, preferably 10 to 100 mole %, based on the incorporated developing agents or dye-releasable compounds (typically DRR compounds) which are described later. Although the compound represented by the general formula (I) or (II) may be contained in a photographic constituent layer (hydrophilic colloid layer) on a support, these compounds are more preferably contained in a photosensitive silver halide emulsion layer.

Details of the compounds represented by the general formula (III) or (IV) are given below.

First, the details of the compounds represented by the general formula (III) are given.

$R^{11}$ represents a hydrogen atom or a substituent group. Specific examples of $R^{11}$ include the following groups. A hydrogen atom, a halogen atom (e.g., a, fluorine, chlorine, or bromine atom), an alkyl group (preferably a straight, branched, or cyclic alkyl group having 1 to 32 carbon atoms, e.g., a methyl, ethyl, propyl, isopropyl, butyl, t-butyl, 1-octyl, tridecyl, cyclopropyl, cyclopentyl, cyclohexyl, 1-norbornyl, or 1-adamantyl), an alkenyl group (preferably an alkenyl group having 2 to 32 carbon atoms, e.g., a vinyl, allyl, or 3-butene-1-yl group), an alkynyl group (preferably an alkynyl group having 2 to 32 carbon atoms, e.g., an ethynyl or 1-propynyl group), an aryl group (preferably an aryl group having 6 to 32 carbon atoms, e.g., a phenyl, 1-naphthyl, or 2-naphthyl group), a heterocyclic group (preferably a 5- to 8-membered heterocyclic group having 1 to 32 carbon atoms, e.g., a 2-thienyl, 4-pyridyl, 2-furyl, 2-pyrimidinyl, 1-pyridyl, 2-benzothiazolyl, 1-imidazolyl, 1-pyrazolyl, or benzotriazole-2-yl group), a silyl group (preferably a silyl group having 3 to 32 carbon atoms, e.g., a trimethylsilyl, triethylsilyl, tributylsilyl, t-butyldimethylsilyl, or t-hexyldimethylsilyl group), a hydroxyl group, an alkoxy group (preferably an alkoxy group having 1 to 32 carbon atoms, e.g., a methoxy, ethoxy and 1-butoxy, 2-butoxy, isopropoxy, t-butoxy, dodecyloxy, cyclopentyloxy, orcyclohexyloxy group), an aryloxy group (preferably an aryloxy group having 6 to 32 carbon atoms, e.g., a phenoxy or 2-naphthoxy group), a heterocycloxy group (preferably a heterocycloxy group having 1 to carbon atoms, e.g., a 1-phenyltetrazole-5-oxy, 2-tetrahydropyranyloxy, or 2-furyloxy group), a silyloxy group (preferably a silyloxy group having 1 to 32 carbon atoms, e.g., a trimethylsilyloxy, t-butyldimethylsilyloxy, or diphenylmethylsilyloxy group), an acyloxy group (preferably an acyloxy group having 2 to 32 carbon atoms, e.g., an acetoxy, pivaloyloxy, benzoyloxy, or dodecanoyloxy group), an alkoxycarbonyloxy group (preferably an alkoxycarbonyloxy group having 2 to 32 carbon atoms, e.g., an ethoxycarbonyloxy, t-butoxycarbonyloxy, or cyclohexyloxycarbonyloxy group), an aryloxycarbonyloxy group (preferably an aryloxycarbonyloxy group having 7 to 32 carbon atoms, e.g., a phenoxycarbonyloxy group), a carbamoyloxy group (preferably a carbamoyloxy group having 1 to 32 carbon atoms, e.g., an N,N-dimethylcarbamoyloxy or N-butylcarbamoyloxy group) a sulfamoyloxy group (preferably a sulfamoyloxy group having 1 to 32 carbon atoms, e.g., an N,N-diethylsulfamoyloxy or N-propylsulfamoyloxy group), an alkanesulfonyloxy group (preferably an alkanesulfonyloxy group having 1 to 32 carbon atoms, e.g., a methanesulfonyloxy or hexadecanesulfonyloxy group), an arenesulfonyloxy group (preferably an arenesulfonyloxy group having 6 to 32 carbon atoms, e.g., a benzenesulfonyloxy group), a cyano group, an acyl groups (preferably an acyl group having 1 to 32 carbon atoms, e.g., a formyl, acetyl, pivaloyl, benzoyl or tetradecanoyl group), an alkoxycarbonyl group (preferably an alkoxycarbonyl group having 2 to 32 carbon atoms, e.g., a methoxycarbonyl, ethoxycarbonyl, octadecyloxycarbonyl, or cyclohexyloxycarbony group), an aryloxycarbonyl group (preferably an aryloxycarbonyl group having 7 to 32 carbon atoms, e.g., a phenoxycarbonyl group), a carbamoyl group (preferably a carbamoyl group having 1 to 32 carbon atoms, e.g., a carbamoyl, N,N-dibutylcarbamoyl, N-ethyl-N-octylcarbamoyl, or N-propylcarbamoyl group), an amino group (preferably an amino group having 32 or less carbon atoms, e.g., an unsubstituted amino, methylamino, N,N-dioctylamino, tetradecylamino, or octadecylamino group), an anilino group (preferably an anilino group having 6 to 32 carbonatoms, e.g., an anilino or N-methylanilino group), a heterocycloamino group (preferably a heterocycloamino group having 1 to 32 carbon atoms, e.g., a 4-pyridylamino group), a carbonamide group (preferably a carbonamide group having 2 to 32 carbon atoms, e.g., an acetoamide, benzamide, or tetradecanamide group), a ureido group (preferably a ureido group having 1 to 32 carbon atoms, e.g., an unsubstituted ureido, N,N-dimethylureido or N-phenylureido group), an imido group (preferably an imido group having 10 or less carbon atoms, e.g., an N-succinimido or N-phthalimide group), an alkoxycarbonylamino group (preferably an alkoxycarbonylamino group having 2 to 32 carbon atoms, e.g., a methoxycarbonylamino, ethoxycarbonylamino, t-butoxycarbonylamino, octadecyloxycarbonylamino, or cycloalkyloxycarbonylamino group), an aryloxycarbonylamino group (preferably an aryloxycarbonylamino group having 7 to 32 carbon atoms, e.g., a phenoxycarbonylamino group), a sulfonamide group (preferably a sulfonamide group having 1 to 32 carbon atom, e.g., a methanesulfonamide, butanesulfonamide, benzenesulfoneamide, or hexadecanesulfonamide group), a sulfamoylamino group (preferably a sulfonamoylamino group having 1 to 32 carbon atoms, e.g., an N,N-dipropylsulfamoylamino or N-ethyl-N-dodecylsulfamoylamino groups), an azo group (preferably an azo group having 1 to 32 carbon atoms, e.g., a phenylazo group), a nitro group, an alkylthio group (preferably an alkylthio group having 1 to 32 carbon atoms, e.g., an ethylthio, octylthio, or cycloalkylthio group), an arylthio group (preferably an arylthio group having 6 to 32 carbon atoms, e.g., a phenylthio group), a heterocyclothio group (preferably a heterocyclothio group having 1 to 32 carbon atoms, e.g., a 2-benzothiazolylthio, 2-pyridylthio, or 1-phenyltetrazolylthio group), an alkanesulfinyl group (preferably an arenesulfinyl group having 1 to 32 carbon atoms, e.g., a dodecanesulfinyl group), an arenesulfinyl group (preferably an arenesulfinyl group having 6 to 32 carbon atoms, e.g., a benzenesulfinyl group), an alkanesulfonyl group (preferably an alkanesulfonyl group having 1 to 32 carbon atoms, e.g., a methanesulfonyl or octanesulfonyl group), an arenesulfonyl group (preferably an arenesulfonyl group having 6 to 32 carbon atoms, e.g., a benzenesulfonyl or 1-naphthalenesulfonyl group), a sulfamoyl group (preferably a sulfamoyl group having 32 or less carbon atoms, e.g., an unsubstituted sulfamoyl, N,N-dipropylsulfamonyl, or N-ethyl-N-dodecylsulfamoyl groups), a sulfo group, a phosphonyl group (preferably a phosphonyl group having 1 to 32 carbon atoms, e.g., a phenoxyphosphonyl, octyloxyphosphonyl, or phenylphosphonyl group), and a phosphinoylamino group (preferably a phosphinoylamino group having 2 to 32 carbon atoms, e.g., a diethoxyphosphinoylamino or dioctyloxyphosphinoylamino group).

$R^{12}$ represents an alkyl group, an alkenyl group, an alkynyl group, an aryl group, a heterocyclic group, an alkoxycarbonyl group, an aryloxycarbonyl group, or a carbamoyl group. Preferred numbers of carbon atoms and specific examples of the foregoing groups are the same as those for groups listed in the explanation of the groups represented by $R^{11}$ i.e., an alkyl group, an alkenyl group, an alkynyl group, an aryl group, a heterocyclic group, an alkoxycarbonyl group, an aryloxycarbonyl group, and a carbamoyl group.

$R^{13}$ represents a hydrogen atom, an alkyl group, an alkenyl group, an alkynyl group, an aryl group, or a heterocyclic group. Preferred numbers of carbon atoms and specific examples of the foregoing groups are the same as those for groups listed in the explanation of the groups represented by $R^{11}$ i.e., an alkyl group, an alkenyl group, an alkynyl group, an aryl group, and a heterocyclic group.

Any group represented by $R^{11}$, $R^{12}$, or $R^{13}$ may further have a substituent group, preferred examples of which are those listed as the substituents groups represented by $R^{11}$.

Next, a preferred scope of the compounds represented by the general formula (III) is explained. Preferably, $R^{11}$ is an alkyl group, an alkoxy group, an amino group, an anilino group, a carbonamide group, a sulfonamide group, an alkoxycarbonyl group, or a cyano group. More preferably, $R^{11}$ is an alkyl group, an alkoxy group, an anilino group, or a carbonamide group. Preferably, $R^{12}$ is an alkyl group, an alkoxycarbonyl group, or a carbamoyl group. More preferably, $R^{12}$ is an alkyl group having 1 to 8 carbon atoms. Most preferably, $R^{12}$ is a methyl group. Preferably, $R^{13}$ is an alkyl group or an aryl group.

Preferred specific examples of the compounds represented by the general formula (III) are given below. However, it should be noted that the present invention is not limited by these examples.

(SCC-1)

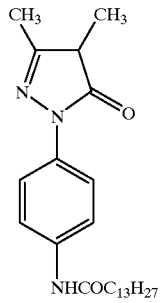

(SCC-2)

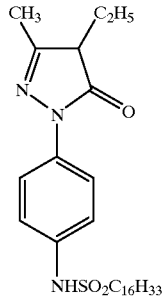

(SCC-3)

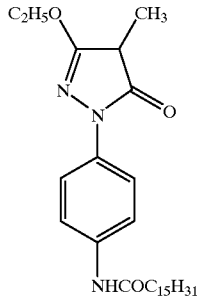

-continued
(SCC-4)
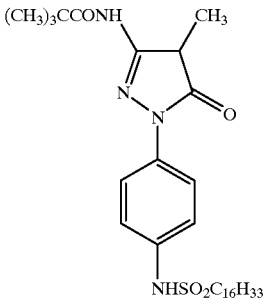
(SCC-5)
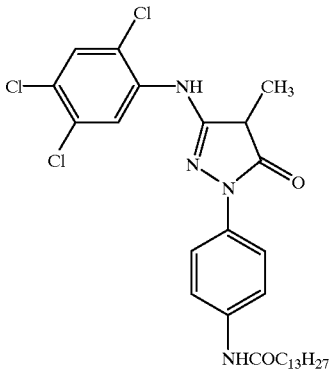
(SCC-6)
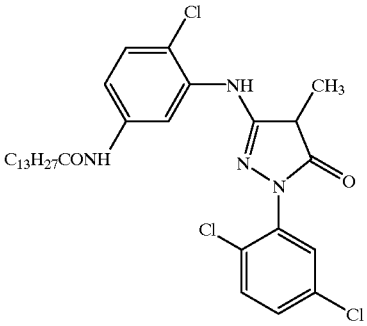
(SCC-7)
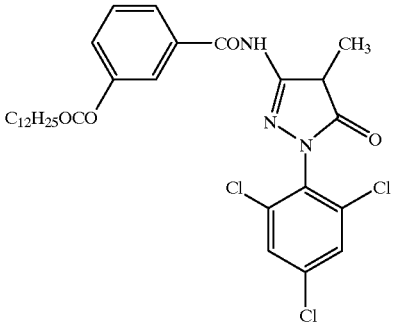
-continued
(SCC-8)
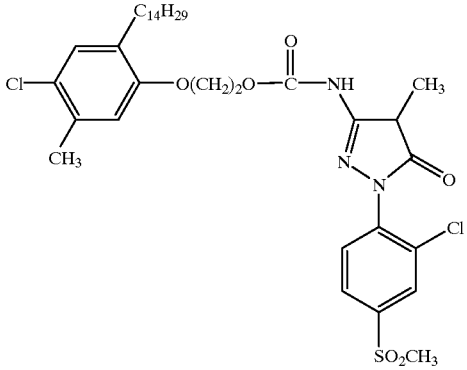
(SCC-9)
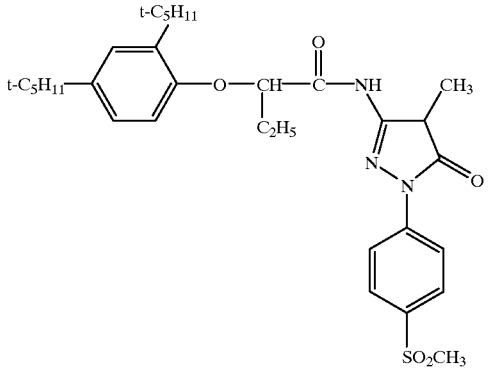
(SCC-10)
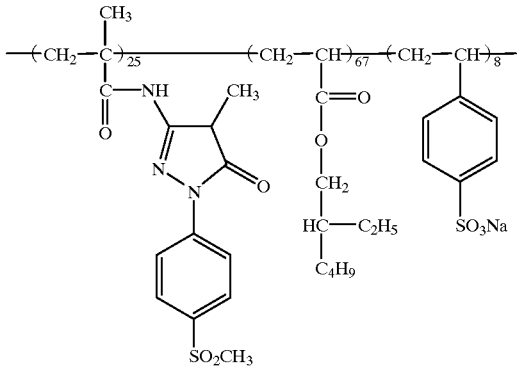
(SCC-11)
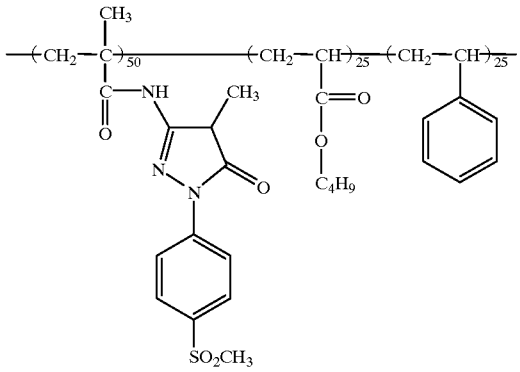

The compounds represented by the general formula (III) can be synthesized by the methods described in U.S. Pat. No. 3,876,438, German Patent Application Laid-Open No. OLS2,428,431, and JP-A No. 62-7,051.

The details of the compounds represented by the general formula (IV) are given below. $R^{14}$ represents an alkyl group, an alkenyl group, an alkynyl group, an aryl group, a heterocyclic group, an alkoxy group, an aryloxy group, a heterocycloxy group, an amino group, or an anilino group. Preferred numbers of carbon atoms and specific examples of the foregoing groups are the same as those for groups listed in the explanation of the groups represented by $R^{11}$ i.e., an alkyl group, an alkenyl group, an alkynyl group, an aryl group, a heterocyclic group, an alkoxy group, an aryloxy group, a heterocycloxy group, an amino group, and an anilino group. $R^{15}$ represents an alkoxycarbonyl group, an aryloxycarbonyl group, or a carbamoyl group. Preferred numbers of carbon atoms and specific examples of the foregoing groups are the same as those for groups listed in the explanation of the groups represented by $R^{11}$ i.e., an alkoxycarbonyl group, an aryloxycarbonyl group, and a carbamoyl group. $R^{16}$ represents an alkyl group, an alkenyl group, an alkynyl group, an aryl group, or a heterocyclic group. Preferred numbers of carbon atoms and specific examples of the foregoing groups are the same as those for groups listed in the explanation of the groups represented by $R^{11}$ i.e., an alkyl group, an alkenyl group, an alkynyl group, an aryl group, and a heterocyclic group. $R^{14}$ and $R^{16}$ may join together to form a 5- to 7-membered ring.

Next, a preferred scope of the compounds represented by the general formula (IV) is explained. Preferably, $R^{14}$ is an alkyl group, an aryl group, a heterocyclic group, an alkoxy group, an aryloxy group, or an anilino group. More preferably, $R^{14}$ is an alkyl group or an aryl group. Preferably, $R^{15}$ is an alkoxycarbonyl group or a carbamoyl group. Most preferably, $R^{15}$ is a carbamoyl group. Preferably, $R^{16}$ is an alkyl group. Among the compounds represented by the general formula (IV) preferable is the compound represented by the following general formula (VI) or (VII).

General formula (VI)

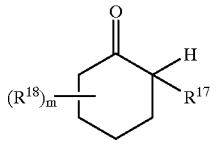

General formula (VII)

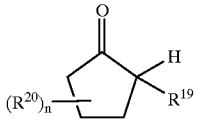

In the general formula (VI), $R^{17}$ is the same as $R^{15}$ in the general formula (IV); $R^{18}$ is the same as $R^{11}$ in the general formula (III); and m is an integer of 0 to 8. Preferably, $R^{17}$ is an alkoxycarbonyl group or a carbamoyl group. Most preferably, $R^{17}$ is a carbamoyl group. Preferably, $R^{18}$ is a halogen atom, an alkyl group, an alkenyl group, an alkynyl group, an aryl group, a heterocyclic group, an alkoxycarbonyl group, an aryloxycarbonyl group, or a carbamoyl group. n is preferably 0 to 2 and most preferably 0.

In the general formula (VII), $R^{19}$ is the same as $R^{15}$ in the general formula (IV); $R^{20}$ is the same as $R^{11}$ in the general formula (III); and n is an integer of 0 to 6. Preferably, $R^{19}$ is an alkoxycarbonyl group or a carbamoyl group. Most preferably, $R^{9}$ is a carbamoyl group. Preferably, $R^{15}$ is a halogen atom, an alkyl group, an alkenyl group, an alkynyl group, an aryl group, a heterocyclic group, an alkoxycarbonyl group, an aryloxycarbonyl group, or a carbamoyl group. n is preferably 0 to 2 and most preferably 0.

Preferred specific examples of the compounds represented by the general formula (IV) are given below. However, it should be noted that the present invention is not limited by these examples.

(SCC-12)

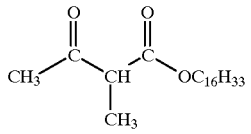

(SCC-13)

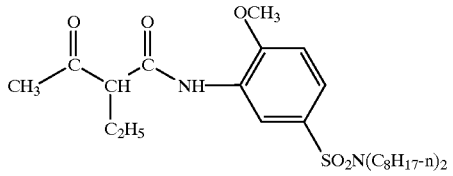

(SCC-14)

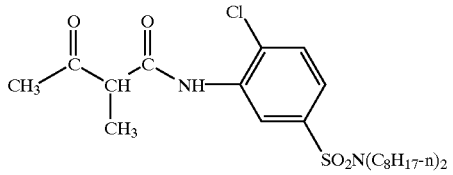

(SCC-15)

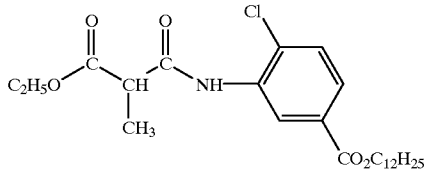

(SCC-16)

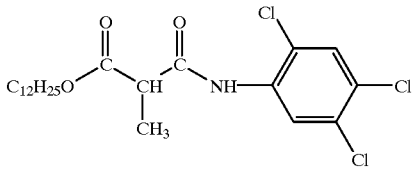

(SCC-17)

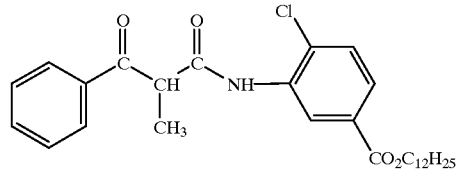

-continued
(SCC-18)
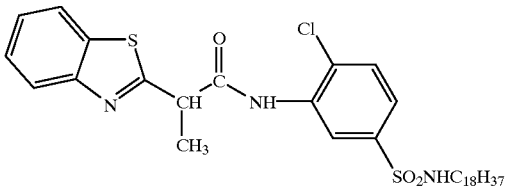
(SCC-19)
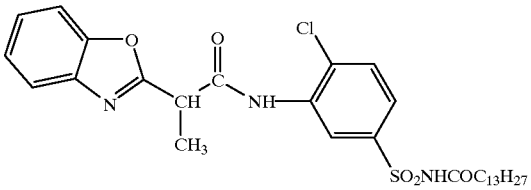
(SCC-20)
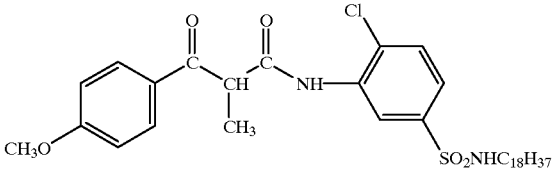
(SCC-21)
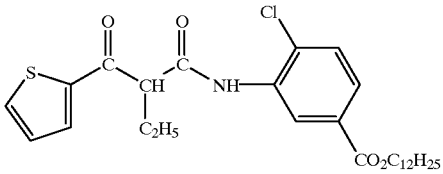
(SCC-22)
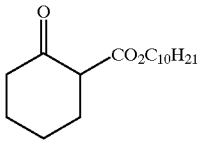
(SCC-23)
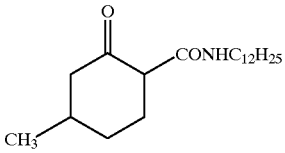
(SCC-24)
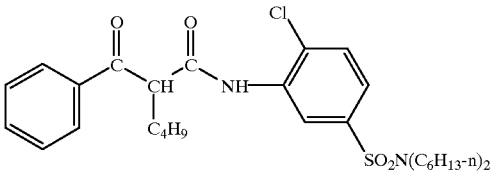
-continued
(SCC-25)
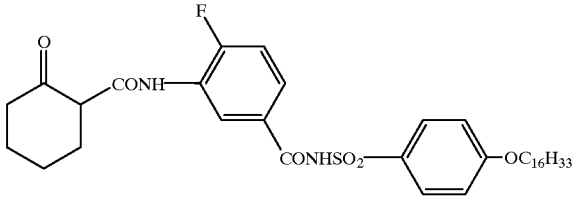
(SCC-26)
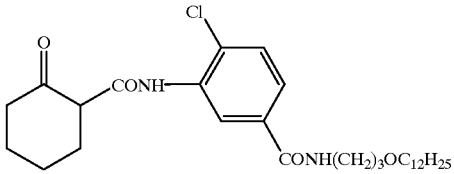
(SCC-27)
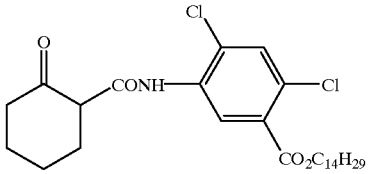
(SCC-28)
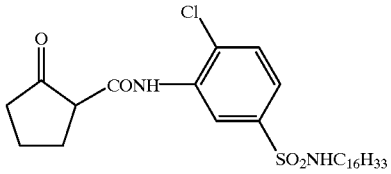
(SCC-29)
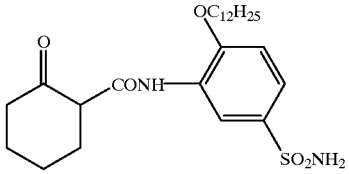
(SCC-30)
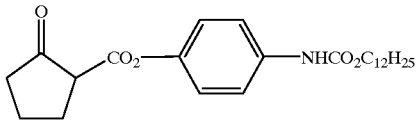
(SCC-31)
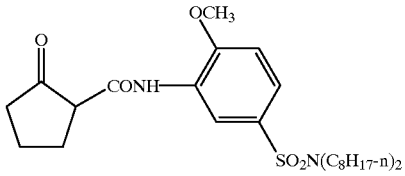
(SCC-32)
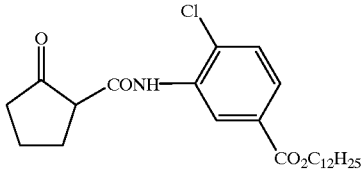

-continued (SCC-33)

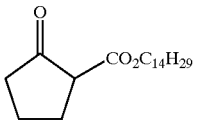

(SCC-34)

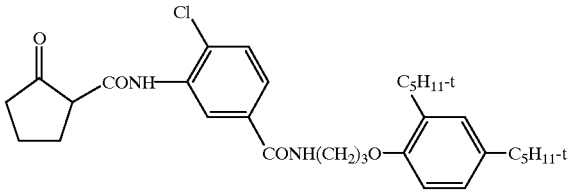

(SCC-35)

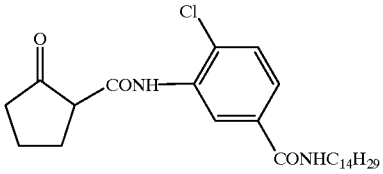

(SCC-36)

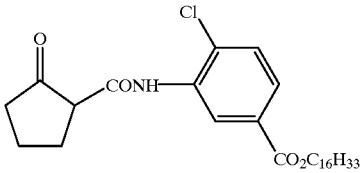

(SCC-37)

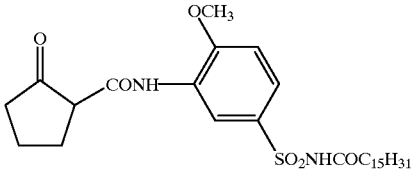

(SCC-38)

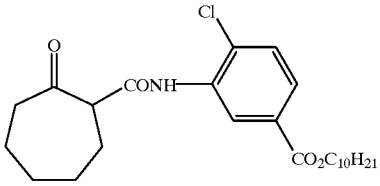

The compounds represented by the general formula (IV) can be synthesized by, for example, the method described in German Patent Application Laid-Open No. DE19,629,142A1.

The amounts to be used of the compounds represented by the general formula (III) or (IV) are usually 50 to 200 mole %, preferably 50 to 100 mole %, based on the dye-releasable compounds which are described later. Preferably, these compounds are contained in an intermediate layer sandwiched between silver halide emulsion layers.

The color photographic photosensitive material for heat development for use in the present invention consists essentially of a construction comprising a support having layers containing the aforementioned compounds and materials. If necessary, the layers may contain such compounds as an oxidizing agent comprising an organic metal salt and a dye-releasable compound (a reducing agent may perform the function of this compound as described later).

Although these compounds are often incorporated in the same layer, they may be incorporated in different layers. For example, if a colored dye-releasable compound is incorporated in a lower layer (i.e., a layer on the far side from the side to be exposed) of the silver halide emulsion layers, the drop in sensitivity can be prevented.

For the formation of a color image, a compound, which releases or forms a diffusive dye in accordance with the reaction in which silver ions are reduced to silver at a high temperature, i.e., a dye-releasable compound, is used in the present invention.

Examples of the dye-releasable compound may include a compound having a function to release a diffusive dye image-wise. This type of compound can be represented by the general formula [L1] given below.

$$((\mathrm{Dye})_m\text{–}\mathrm{Y})_n\text{–}\mathrm{Z} \qquad [L1]$$

In the formula, Dye represents a dye group or a dye precursor group or a dye group or a dye precursor group having the absorption wavelength region thereof temporarily shifted in a short wavelength region; Y represents a simple bond or a linking group; Z represents a group which causes a difference in the diffusivity of the compound represented by the formula $((\mathrm{Dye})_m\text{–}\mathrm{Y})_n\text{–}\mathrm{Z}$ conforming to the image-wise latent image of a photosensitive silver salt, or which releases $(\mathrm{Dye})_m\text{–}\mathrm{Y}$ and causes a difference between the diffusivity of the released $(\mathrm{Dye})_m\text{–}\mathrm{Y}$ and that of $((\mathrm{Dye})_m\text{–}\mathrm{Y})_n\text{–}\mathrm{Z}$; m is an integer of 1 to 5; n is 1 or 2; and the plurality of Dyes may be the same or different if both m and are not 1. More specifically, the dye-releasable compound is any one of the following compounds (i) and (ii).

(i) Compounds which are couplers having a diffusive dye as a leaving group and release the diffusive dye by reacting with an oxidized form of a reducing agent and which themselves are non-diffusive compounds (hereinafter referred to as "DOR coupler" on occasion). Specific examples of these compounds include those described in, e.g., U.K. Patent No. 1,330,524, JP-B No. 48-39,165, U.S. Pat. Nos. 3,443,940, 4,474,867, and 4,483,914.

(ii) Compounds which can reduce a silver halide or an organic silver salt and release a diffusive dye after reducing the silver halide or the organic silver salt and which themselves are non-diffusive compounds (hereinafter referred to as "DRR compounds" on occasion). Typical examples of these compounds are described in, e.g., U.S. Pat. Nos. 3,928,312, 4,053,312, 4,055,428, and 4,336,322, JP-A Nos. 56-65,839, 59-69,839, 53-3,819, and 51-104,343, RD 17,465, U.S. Pat. Nos. 3,725,062, 3,728,113, and 4,443,939, JP-A Nos. 58-116,537 and 57-179,840, and U.S. Pat. No. 4,500,626. Specific examples of the DDR compounds may include those described in U.S. Pat. No. 4,500,626, columns 22–44. Among these compounds described in this patent, compounds (1)~(3), (10)~(13) (16)~(19), (28)~(30), (33)~(35), (38)~(40) and (42)~(64) are preferable. Also useful are the compounds described in U.S. Pat. No. 4,639,408, columns 37–39. Besides the above-described couplers and dye-releasable compounds represented by the general formula [L1], also usable are a dye/silver compound in which an organic silver salt is linked with a dye (e.g., Journal of Research Disclosure, May, 1978, pp.54–58), an azo dye which is used for dye-bleaching of heat-developed silver (e.g., U.S. Pat. No. 4,235,957 and Journal of Research Disclosure, April, 1976, pp.30–32), a leuco dye (e.g., U.S. Pat. No. 3,985,565 and 4,022,617), and others.

In addition to the above-described dye forming methods, a method for forming a diffusive dye by a coupling reaction between an incorporated active agent and coupler is known by JP-A Nos. 8-286,340, 10-142,764, and 10-254,111. It is preferable to use the method for dye formation by coupling or the method for dye formation by DRR compounds in the present invention.

When a layer, which contains such a dye-releasable compound, is formed, the content of the compound is generally 0.3 to 1 mmol/$m^2$ and preferably 0.3 to 0.5 mmol/$m^2$.

In order to obtain colors covering wide areas in a chromaticity diagram by using 3 primary colors of yellow, magenta, and cyan, a combination of at least 3 silver halide emulsion layers, which each have sensitivity in different spectral regions, is used. Examples of the combination include a combination of a blue-sensitive layer, a green-sensitive layer, and a red-sensitive layer, a combination of a green-sensitive layer, a red-sensitive layer, and an infrared-sensitive layer, and a combination of a red-sensitive layer, an infrared-sensitive layer (1), and an infrared-sensitive layer (2), as described in, for example, JP-A Nos. 59-180,550, 64-13,546, and 62-253,159, and European Patent Application Laid-Open No. 479,167. A variety of configurational orders of layers known in ordinary color photographic photosensitive materials can be adopted for arranging the above-described layers. In addition, if necessary, each of the above-described photosensitive layers may be divided into 2 or more layers as described in JP-A No. 1-252,954. In a photo sensitive material for heat development, a variety of non-photosensitive layers, such as a protective layer, a subbing layer, an intermediate layer, a yellow filter layer, and an antihalation layer, may be formed between the silver halide emulsion layers, or as the uppermost layer or the lowermost layer. Further, an auxiliary layer, such as a back layer, may be formed on the reverse side of the support. More specifically, it is possible to form various layers which include the layer configurations described in above-mentioned patents, a subbing layer described in U.S. Pat. No. 5,051,335, an intermediate layer containing a solid pigment described in JP-A Nos.1-167,838 and 61-20,943, an intermediate layer containing a reducing agent and a DIR compound described in JP-A Nos.1-129,553, 5-34,884, and 2-64,634, an intermediate layer containing an electron transferring agent described in U.S. Pat. Nos. 5,017,454, and 4,139,919, and JP-A No. 2-235,044, and a protective layer containing a reducing agent described in JP-A No. 4-249,245 as well as a combination of these layers. It is preferable that the support has an antistatic property and is prepared such that the surface resistivity is not greater than $10^{12}$ Ω·cm.

Next, details of the silver halide emulsion to be used in the photosensitive material for heat development are given below. The silver halide emulsion usable in the present invention may be any one selected from the group consisting of silver chloride, silver bromide, silver iodobromide, silver chlorobromide, silver chloroiodide, and silver chloroiodobromide.

The silver halide emulsion for use in the present invention may be any of a surface latent image type and an interior latent image type. The interior latent image type emulsion is combined with a nucleating agent or a light-fogging agent to be used as a direct reversing emulsion. If the silver halide grains contained in the silver halide emulsion of the present invention are composed of a mixture of grains made up of different silver halides, the grain may have a homogeneous intra-grain composition. In addition, it is also preferable that the grain may take a so-called laminate structure made up of a plurality of layers having different halogen compositions inside the grain. Examples of the latter type may include a so-called core/shell type emulsion in which the composition inside the grain differs from the composition on the grain surface. Besides the laminate structure, also preferable is a structure in which local phases having different halogen compositions are present inside the grain. Preferred examples of the grain may include a grain having a structure in which the face, ridge, or top of a silver halide grain serving as a base is epitaxially joined with a silver halide having a different composition. Furthermore, it is preferable that such a local phase is formed inside the grain. The silver halide grains constituting the silver halide emulsion may have a monodispersed or polydispersed grain size distribution. For example, methods, which are described in JP-A Nos. 1-167,743 and 4-223,463 and in which a gradation is adjusted by blending monodispersed emulsions having different grain sizes and sensitivities, are preferably employed. The grain size is preferably 0.1 to 2 μm and most preferably 0.2 to 1.5 μm. The crystal habit of the silver halide grain may be selected from a regularly structured crystal such as a cube, octahedron, or tetradecahedron, a sphere, an irregularly structured crystal such as a plane having a high aspect ratio, a crystal having a crystal defect such as twin planes, and a mixture of the foregoing.

More specifically, all silver halide emulsions prepared by the methods described in the following publications can be used. U.S. Pat. Nos. 4,500,626, column 50, and 4,628,021; Journal of Research Disclosure (hereinafter abbreviated as RD) No. 17,029 (1978), No. 17,643 (December, 1978), pp.22–23, No. 18,716 (November, 1979), pp.648, No. 307, 105 (November, 1989), pp.863–865; JP-A Nos. 62-253,159, 64-13,546, 2-,236,546, and 3-110,555; P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964.

The photosensitive silver halide emulsion for use in the present invention preferably contains ions of transition metal elements, such as titan, iron, cobalt, ruthenium, rhodium, osmium, iridium, and platinum, ortypical metal ions, such as zinc, cadmium, thallium, and lead, in the interior or surface of grains for a variety of purposes such as enhancement of sensitivity, sharpening of contrast, improvement of reciprocity law failure, improvement of the stability of latent image, and improvement of pressure resistance. These metal ions are introduced as salts or complex salts. Particularly, when ions of transition metals are introduced, it is preferable to use these ions as a complex having ammonia, halogen, cyan, thiocyan, nitrosyl, or the like as a ligand, or as a complex having an organic ligand such as imidazole, triazole, pyridine, bipyridine, or the like as a ligand. These ligands are used alone or in a combination of two or more of them. Moreover, these compounds may be used alone or in a combination of two or more of them. The amounts added of these compounds vary depending on the purposes of use, but the amounts are generally about $10^{-9}$ to $10^{-3}$ mol per mol of silver halide. When introduced, these compounds may be introduced uniformly into the grain or may be localized inside or on the surface of the grain. More specifically, the emulsions described in JP-A Nos. 2-236,542, 1-116,637, 5-181,246, and others are preferably used.

Compounds such as a rhodanate, ammonia, a tetra-substituted thioether compound, an organic thioether derivative described in JP-B No. 47-11,386, or a sulfur-containing compound described in JP-A No. 53-144,319 can be used as a solvent for silver halide in the grain forming stage of the photosensitive silver halide emulsion of the present invention.

For other conditions, reference will be made, for example, to P.Glafkides, Chimie et Physique Photographique, Paul Montel, 1967; G. F. Duffin, Photographic Emulsion Chemistry, Focal Press, 1966; V. L. Zelikman et al., Making and Coating Photographic Emulsion, Focal Press, 1964; and the like. That is, the method employed may be any one selected from an acidic method, a neutral method, and an ammonia method. Further, any method selected from a half mixing method, a simultaneous mixing method, and a combination thereof may be used as a method for reacting a soluble silver salt with a soluble halogen salt. A simultaneous mixing method is advantageously employed for obtaining a monodispersed emulsion.

An inverse mixing method in which grains are formed in the presence of an excess of silver ions can also be employed. A so-called controlled double jet method in which pAg of the liquid phase for the formation of silver halide is kept constant can also be employed as a simultaneous mixing method.

Meanwhile, the concentrations, added amounts, and adding rates of the silver salts and halogen salt to be added may be increased in order to accelerate the growth of the grains (JP-A Nos. 55-142,329 and 55-158,124, and U.S. Pat. No. 3,650,757).

The stirring of the reaction mixture may be effected by any known method. Further, the temperature and pH of the reaction mixture during the formation of silver halide grains may be selected depending on the purposes. The pH ranges preferably from 2.3 to 8.5 and more preferably from 2.5 to 7.5.

In the process for the formation of the photosensitive silver halide emulsion of the present invention, a so-called desalting treatment is preferably performed so as to remove excess salt. For this purpose, a noodle washing process in which desalting is carried out by gelling a gelatin solution; and a precipitation process in which desalting is carried out by utilizing a compound such as an inorganic salt comprising a polyvalent anion (e.g., sodium sulfate), an anionic surfactant, an anionic polymer (e.g., sodium polystyrenesulfonate), or a gelatin derivative (e.g., aliphatic-acylated gelatin, aromatic-acylated gelatin, aromatic-carbamoylated gelatin, or the like) maybe employed. The precipitation process is preferably employed.

Normally, the photosensitive silver halide emulsion is chemically sensitized. A sensitizing method by means of chalcogen, such as sulfur sensitization, selenium sensitization, or tellurium sensitization, a sensitization method by means of a noble metal, such as gold, platinum, or palladium, and a sensitization method by means of reduction, which are all known sensitizing methods, may be used alone or in combination thereof for the chemical sensitization of the photosensitive silver halide emulsion (e.g., JP-A Nos. 3-110,555 and 5-241,267). These chemical sensitizations can be performed in the presence of a nitrogen-containing heterocyclic compound (JP-A No. 62-253,159). Also, an anti-fogging agent, described later, may be added to a silver halide emulsion after the chemical sensitization thereof is completed. More specifically, the methods, which are described in JP-A Nos. 5-45,833 and 62-40,446, can be used.

When a chemical sensitization is carried out, the pH is preferably in the range of from 5.3 to 10.5 and more preferably in the range of from 5.5 to 8.5, while the pAg is preferably in the range of 6.0 to 10.5 and more preferably in the range of from 6.8 to 9.0.

The coating weight of the photosensitive silver halide emulsion to be used in the present invention is in the range of from 1 mg to 10 g/m$^2$, and preferably in the range of from 10 mg to 10 g/m2, based on the weight of silver.

In order to impart color-sensitivity, such as green-sensitivity, red-sensitivity, or infrared-sensitivity, to the photosensitive silver halide to be used in the present invention, the photosensitive silver halide emulsion is spectrally sensitized generally by means of a methine dye or the like. Further, if necessary, a blue-sensitive emulsion may be subject to spectral sensitization of a blue color region.

Examples of employable dyes may include cyanine dyes, merocyanine dyes, complex cyanine dyes, complex merocyanine dyes, holopolar cyanine dyes, hemicyanine dyes, styryl dyes, and hemioxonol dyes. More specific examples of these sensitizing dyes are disclosed in, for example, U.S. Pat. No. 4,617,257, and JP-A Nos. 59-180,550, 64-13,546, 5-45,828, and 5-45,834. Although these sensitizing dyes may be used alone, they may also be used in a combination thereof. A combination of these sensitizing dyes is often used particularly for the purpose of supersensitization or wavelength adjustment of spectral sensitization. The photosensitive silver halide emulsion may contain, together with the sensitizing dye, a compound which is a dye having no spectral sensitization effect in itself or a compound substantially incapable of absorbing visible light but which exhibits a supersensitizing effect (these compounds are described in, for example, U.S. Pat. No. 3,615,641 and JP-A No.63-23,145).

These sensitizing dyes may be added to the emulsion at the stage of chemical ripening or before or after the chemical ripening, or before or after the formation of the nuclei of the silver halide grains in accordance with the descriptions in U.S. Pat. Nos. 4,183,756 and 4,225,666. These sensitizing dyes or supersensitizers may be added to the emulsion as a solution in an organic solvent, such as methanol, as a dispersion in gelatin, or as a solution in a surfactant. The amount to be added is generally in the range of $10^{-8}$ to $10^{-2}$ mol per mol or so of silver halide.

The additives to be used in the above-described stages and the known photographic additives usable in the photosensitive material for heat development or in dye-fixing materials of the present invention are described in aforesaid RD No. 17,643, No. 18,716, and No. 307,105. The following table shows the relevant references.

| Additives | RD17,643 | RD18,716 | RD307,105 |
|---|---|---|---|
| 1. Chemical sensitizers | page 23 | page 648, right column | page 866 |
| 2. Sensitivity increasing agents | | page 648, right column | |
| 3. Spectral sensitizers, Supersensitizers | pages 23–24 | page 648, right column to page 649, right column | pages 866–868 |
| 4. Fluorescent brighteners | page 24 | page 648, right column | page 868 |
| 5. Anti-fogging agents, Stabilizers | pages 24–25 | page 649, right column | pages 868–870 |

-continued

| Additives | RD17,643 | RD18,716 | RD307,105 |
|---|---|---|---|
| 6. Light absorbers, Filter dyes, Ultraviolet absorbers | pages 25–26 | page 649, right column to page 650, left column | page 873 |
| 7. Dye image stabilizers | page 25 | page 650, left column | page 872 |
| 8. Hardeners | page 26 | page 651, left column | pages 874–875 |
| 9. Binders | page 26 | page 651, left column | pages 873–874 |
| 10. Plasticizers, lubricants | page 27 | page 650, right column | page 876 |
| 11. Coating aids, Surfactants | pages 26–27 | page 650, right column | pages 875–876 |
| 12. Antistatic agents | page 27 | page 650, right column | pages 876–877 |
| 13. Matting agents | | | pages 878–879 |

The binder for a constituent layer of the photosensitive material for heat development or of the dye-fixing material is preferably a hydrophilic material. Examples of the binder may include those described in the aforesaid Research Disclosure and in JP-A No.64-13,546, pp.71–75. More specifically, the binder is preferably a transparent or translucent hydrophilic material, exemplified by a naturally occurring compound, such as a protein including gelatin and a gelatin derivative, and a polysaccharide including a cellulose derivative, starch, gum arabic, dextran, and pullulan, and by a synthetic polymer such as polyvinyl alcohol, polyvinyl pyrrolidone, and an acrylamide polymer. Also usable as the binder is a highly water-absorbent polymer described in U.S. Pat. No. 4,960,681, JP-A No. 62-245,260, and others. For example, a homopolymer composed of a vinyl monomer having —COOM or —$SO_3M$ (M stands for a hydrogen atom or an alkali metal), or a copolymer obtained by a combination of these vinyl monomers or by a combination of any of these vinyl monomers and another vinyl monomer such as sodium methacrylate or ammonium methacrylate (e.g., SUMIKAGEL L-5H manufactured by Sumitomo Chemical Co., Ltd.). These binders may be used alone or in a combination of two or more of them. In particular, a combination of gelatin and any of the above-mentioned binders is preferable. As to the gelatin, depending on the purposes, it may be selected from lime-treated gelatin, acid-treated gelatin, and delimed gelatin which has undergone a deliming treatment to decrease the content of calcium. Alternatively, the use of a combination of these treated gelatin substances is also preferable.

In the case where a system involving heat development by use of a small amount of water is adopted, the use of the above-mentioned highly water-absorbent polymer makes it possible to rapidly absorb water. Further, the use of the above-mentioned highly water-absorbent polymer in the dye-fixing layer or protective layer thereof prevents the dye after transfer from being transferred again from the dye-fixing element to another element.

In the present invention, the coating weight of the binder is preferably 20 g or less per $m^2$, more preferably 10 g or less per $m^2$, and most preferably 7 to 0.5 g per $m^2$.

An organic metal salt may be used as an oxidizing agent together with a photosensitive silver halide emulsion in the present invention. Among these organic metal salts, an organic silver salt is particularly preferable.

Examples of the organic compounds which can be used for the preparation of the above-mentioned organic silver salts based oxidizing agents include benzotriazoles, fatty acids, and other compounds described in U.S. Pat. No. 4,500,626, columns 52–53. The silver acetylide, which is described in U.S. Pat. No. 4,775,613, is also useful. These organic silver salts may be used alone or in a combination of two or more of them.

The above-mentioned organic silver salt can be used in an amount ranging from 0.01 to 10 mol, preferably from 0.01 to 1 mol, per mol of the photosensitive silver halide. The total coating weight of the photosensitive silver halide emulsion and the organic silver salt is in the range of from 0.05 mg to 10 g/$m^2$, preferably from 0.1 g to 4 g/$m^2$, based on the weight of silver.

Examples of the reducing agent usable in the present invention may include reducing agents known in the field of a photosensitive material for heat development. In addition, examples of the reducing agent may include the dye-releasable compounds described previously which can function as a reducing agent (in this case, other reducing agent may be used together with the dye-releasable compound). Furthermore, a precursor of the reducing agent, which itself has no reducing capability but is given a reducing capability by a nucleophilic reagent or heat in the developing process, can also be used.

Examples of the reducing agents usable in the present invention include the reducing agents and precursors thereof described in U.S. Pat. Nos. 4,500,626, columns 49–50, 4,839,272, 4,330,617, 4,590,152, 5,017,454, and 5,139,919, JP-A Nos.60-140,335, pp.17–18, 57-40,245, 56-138,736, 59-178,458, 59-53,831, 59-182,449, 59-182,450, 60-119, 555, 60-128,436, 60-128,439, 60-198,540, 60-181,742, 61-259,253, 62-201,434, 62-244,044, 62-131,253, 62-131, 256, 63-10,151, 64-13,546, pp.40–57, 1-120,553, 2-32,338, 2-35,451, 2-234,158, and 3-160,443, and European Patent No.220,746, pp.78–96.

Furthermore, combinations of reducing agents, which are disclosed in U.S. Pat. No. 3,039,869, can also be used in the present invention.

In the case where a diffusion-resistant reducing agent is used, an electron transferring agent and/or a precursor thereof may be used in combination with diffusion-resistant reducing agent, if necessary, so as to accelerate the electron transfer between the diffusion-resistant reducing agent and developable silver halides. Particularly preferable examples of these compounds for use in the present invention may include those described in above-mentioned U.S. Pat. No. 5,139,919, European Patent No.418,743, JP-A Nos. 1-138, 556, and 3-102,353. Also suitable for use are the methods, described in JP-A Nos. 2-230,143 and 2-235,044, in which the compounds are introduced into layers in a stable manner.

The electron transferring agent or a precursor thereof may be selected from the reducing agents or precursors thereof listed previously. The mobility of the electron transferring agent or precursor thereof is desirably larger than that of the diffusion-resistant reducing agent (i.e., electron donor). Particularly useful electron transferring agents are 1-phenyl-3-pyrazolidone based compounds or aminophenol-based compounds.

The diffusion-resistant reducing agent (i.e., electron donor) for use in combination with the electron transferring agent is one which is selected from the reducing agents listed previously and which has no substantial mobility in the layer of the photosensitive material. Preferable examples may include hydroquinones, the compounds described as electron donors in JP-A No. 53-110,827, U.S. Pat. Nos. 5,032,487, 5,026,634, and 4,839,272, and dye-releasable compounds which are described later and characterized by a diffusion-resistant property and a reducing capability.

A precursor of an electron donor, described in JP-A No. 3-160,443, is also suited for use in the present invention.

For such purposes as prevention of color mixing, improvement of color reproduction, improvement of whiteness of white ground, and prevention of silver from being transferred to dye fixing materials, the above-described reducing agent can be used in an intermediate layer or in a protective layer. Specifically, the reducing agents, which are described in European Patent Application Laid-Open Nos. 524, 649 and 357,040, JP-A Nos. 4-249,245, 2-64,633, 2-46,450, and 63-186,240, are preferably used in the present invention. Also usable are development inhibitor releasing reducers which are described in JP-B No. 3-63,733, JP-A Nos. 1-150,135, 2-110,557, 2-64,634, and 3-43,735, and European Patent Application Laid-Open No. 451, 833.

In the present invention, the total amount added of the reducing agent is 0.01 to 20 mol, preferably 0.1 to 10 mol, per mol of silver.

Hydrophobic additives, such as a dye-releasable compound and a diffusion-resistant reducing agent, can be introduced into a layer of a photosensitive material for heat development according to a known method such as one described in U.S. Pat. No. 2,322,027. In this case, an organic solvent having a high boiling point, which is described in U.S. Pat. Nos. 4,555,470, 4,536,466, 4,536,467, 4,587,206, 4,555,476, and 4,599,296, JP-B No. 3-62,256, and others, can be used, if necessary, together with an organic solvent having a lower boiling point in the range of from 50 to 160° C. These dye-releasable compounds, diffusion-resistant reducing agents, organic solvents having a high boiling point, and the like may be used in a combination of two or more of them, respectively. The amount of the organic solvent having a high boiling point is to be 10 g or less, preferably 5 g or less, and more preferably 1 to 0.1 g, per gram of the dye-releasable compound to be used. The amount of the organic solvent having a high boiling point is to be 1 cc or less, preferably 0.5 cc or less, and more preferably 0.3 cc or less, per gram of the binder. Examples of the methods usable for introducing the hydrophobic additives into a layer of the photosensitive material include a dispersion method utilizing a polymer as described in JP-B No. 51-39,853 and JP-A No. 51-59,943, and a method in which the hydrophobic additive converted into a dispersion of fine particles in advance is added to a layer as described in JP-A No. 62-30,242.

In addition to the above-described methods, in the case where the hydrophobic compound is a compound substantially insoluble in water, the hydrophobic compound can be dispersed as fine particles in a binder. When dispersing a hydrophobic compound in a hydrophilic colloid, a variety of surfactants can be used. For example, surfactants, which are described in JP-A No. 59-157, 636, pp. -37–38 and in aforesaid Research Disclosure, can be used.

The photosensitive material for heat development of the present invention may contain a compound which activates the development and simultaneously stabilizes the images. Preferred specific examples of the compound are described in U.S. Pat. No. 4,500,626, columns 51–52.

In a system in which images are formed by the diffusive transfer of dyes, a variety of compounds may be added to the constituent layers of the photosensitive material for heat development of the present invention in order to immobilize or decolorize unnecessary dyes or colored substances so that the whiteness of the white ground of the image to be obtained is improved. More specifically, compounds described in European Patent Application Laid-Open Nos. 353,741 and 461,416, and JP-A Nos. 63-163,345 and 62-203,158 can be used.

In the constituent layers of the photosensitive material for heat development of the present invention, a variety of pigments or dyes may be used to improve color separation or to enhance sensitivity. More specifically, usable for such purposes are compounds described in aforesaid Research Disclosure as well as compounds or layer structures described in European Patent Application Laid-Open Nos. 479,167 and 502,508, JP-A Nos. 1-167,838, 4-343,355, 2-168,252, and 61-20,943, European Patent Application Laid-Open Nos. 479,167 and 502,508, and others.

In a system in which images are formed by the diffusive transfer of dyes, a dye fixing material is used together with a photosensitive material for heat development. The dye fixing material may be coated on a support different from that for the photosensitive material, or the dye fixing material may be coated on the same support as that for the photosensitive material. The relationship of the photosensitive material with the dye fixing material, a support, and a white reflective layer described in U.S. Pat. No. 4,500,626 can also be applied to the present invention.

The color fixing material preferably usable in the present invention has at least one layer containing a mordant and a binder. The mordant usable in the present invention can be selected from those known in the field of photography. Specific examples of the mordant may include those described in U.S. Pat. No. 4,500,626, columns 58–59, JP-A No. 61-88,256, pp.32–41, and JP-A No. 1–161,236, pp.4–7 as well as those described in U.S. Pat. Nos. 4,774,162, 4,619,883, and 4,594,308. In addition, dye-receivable polymeric compounds described in U.S. Pat. No. 4,463,079 can also be used.

The binder to be used in the dye fixing material of the present invention is preferably the hydrophilic binder described previously. Preferably, the binder is used in combination with a carrageenan-based compound as described in European Patent Application Laid-Open No. 443,529 or in combination with a latex having a glass transition temperature of 40° C. or below as described in JP-B No. 3-74,820.

In the dye fixing material, if necessary, auxiliary layers, such as a protective layer, a peelable layer, a subbing layer, an intermediate layer, a back layer, a curling preventing layer, and so on, may be formed. Particularly, the formation of the protective layer is useful.

In the constituent layers of the photosensitive material for heat development and the dye fixing material, an organic solvent having a high boiling point can be used as a plasticizer, a slicking agent, or an agent to improve the peelability of the photosensitive material from the dye fixing material. Specific examples of the organic solvent include those described in the aforesaid Research Disclosure, JP-A No. 62-245,253, and others.

For the above-described purpose, a variety of silicone oils (all types of silicone oils including not only a dimethylsilicone oil but also a modified silicone oil having various organic groups introduced to dimethylsiloxane) can also be used. Examples of the silicone oil include various modified silicone oils, carboxy-modified silicone (trade name: X-22-3710) in particular, described in a technical publication "Modified Silicone Oils", pp.6–18B, issued from Shin-Etsu Silicone Co., Ltd.

Also useful are silicone oils described in JP-A Nos. 62-215,953 and 63-46,449.

The photosensitive material for heat development or dye fixing material may contain an anti-fading agent. Examples of the anti-fading agent include an antioxidant, an ultraviolet absorber, and a kind of metal complex. Also useful are stabilizers for dye images and ultraviolet absorbers described in the aforesaid Research Disclosure.

Examples of the antioxidant include chroman-based compounds, coumarin-based compounds, phenol-based compounds (e.g., hindered phenols), derivatives of hydroquinone, derivatives of hindered amines, and spiroindan-based compounds. Also effective are compounds described in JP-A No. 61-159,644.

Examples of the ultraviolet absorber include benzotriazole-based compounds (e.g., those described in U.S. Pat. No. 3,533,794 and others), 4-thiazolidone-based compounds (e.g., those described in U.S. Pat. No. 3,352,681 and others), benzophenone-based compounds (e.g., those described in JP-A No. 46-2,784 and others), and compounds described in JP-A Nos. 54-48,535, 62-136,641, 61-88,256, and others. Also effective is the polymer capable of absorbing ultraviolet light described in JP-A No. 62-260,152.

Examples of the metal complex include compounds described in U.S. Pat. Nos. 4,241,155, 4,245,018, columns 3–36, and 4,254,195, columns 3–8, and in JP-A Nos. 62-174,741, 61-88,256, pp.27–29, 63-199,248, 1-75,568, 1-74,272, and others.

The anti-fading agent intended for the prevention of the fading of the dye transferred to a dye fixing material may be incorporated in the dye fixing material in advance, or alternatively, the anti-fading agent may be externally supplied to the dye fixing material from other source such as from a photosensitive material for heat development or a solvent for transfer which is described later.

The oxidation preventing agent, ultraviolet absorber, and metal complex may be used in combination.

The photosensitive material for heat development or dye fixing material may contain a fluorescent brightener. Preferably, the fluorescent brightener is incorporated in the dye fixing material or it is supplied externally such as from a photosensitive material for heat development or a solvent for transfer. Example of the fluorescent brightener may include the compounds described in K. Veenkataraman, ed., "The Chemistry of Synthetic Dyes", vol. 5, chapter 8, JP-A No.61-143,752, and others. Specific examples of the fluorescent brightener may include stilbene-based compounds, coumarin-based compounds, biphenyl-based compounds, benzoxazolyl-based compounds, naphthalimide-based compounds, pyrazoline-based compounds, and carbostyryl-based compounds.

The fluorescent brightener can be used together with an anti-fading agent or an ultraviolet absorber. Specific examples of the anti-fading agent, ultraviolet absorber, and fluorescent brightener are described in JP-A Nos. 62-215,272, pp.125–137, and 1-161,236, pp.17–43.

The hardener for use in the constituent layers of the photosensitive material for heat development or dye fixing material may include the hardeners described in aforesaid Research Disclosure, U.S. Pat. Nos. 4,678,739, column 41, and 4,791,042, JP-A Nos. 59-116,655, 62-245,261, 61-18,942, and 4-218,044, and others. More specifically, examples of these hardeners include an aldehydes (e.g., formaldehyde), aziridines, epoxies, vinylsulfones (e.g., N,N'-ethylene-bis(vinylsulfonylacetoamide)ethane), N-methylol compounds (e.g., dimethylolurea), and polymeric hardeners (e.g., a compound described in JP-A No.62-234,157 and others).

The amount of the hardener to be added is in the range of from 0.001 g to 1 g, preferably from 0.005 to 0.5 g, per gram of the hydrophilic binder. The hardener may be added to any one layer of the constituent layers of the photosensitive material or dye fixing material or may be added to two or more layers of these materials.

A constituent layer of the photosensitive material for heat development or dye fixing material may contain an anti-fogging agent or a photographic stabilizer as well as a precursor thereof, examples of which may include the compounds described in the aforesaid Research Disclosure, U.S. Pat. Nos. 5,089,378, 4,500,627 and 4,614,702, JP-A No.62-13,564, pp.7–9, pp.57–71, and pp.81–97, U.S. Pat. Nos. 4,775,610, 4,626,500, and 4,983,494, JP-A Nos.62-174,747, 62-239,148, 63-264,747, 1-150,135, 2-110,557, and 2-178,650, RD 17,643 (1978) pp.24–25, and others.

The amounts added of these compounds are preferably in the range of from $5\times10^{-6}$ to $1\times10^{-1}$ mol, more preferably from $1\times10^{-5}$ to $1\times10^{-2}$ mol, per mol of silver.

A variety of surfactants can be used in constituent layers of the photosensitive material for heat development or dye fixing material for such purposes as coating aids, improvement of peelability, improvement of sliding property, prevention of electrostatic charge, and acceleration of development. Specific examples of the surfactant are described in the aforesaid Research Disclosure, JP-A No.62-173,463, 62183,457, and others.

For such purposes as improvement of sliding property, prevention of electrostatic charge, and improvement of peelability, an organic fluorine-containing compound may be incorporated in constituent layers of the photosensitive material for heat development or dye fixing material. Typical examples of the organic fluorine-containing compound may include a fluorine-containing surfactant and a hydrophobic fluorine-containing compound such as an oily fluorine compound, e.g., fluorocarbon oil, and a solid fluorine-containing resin, e.g., tetrafluoroethylene, described in JP-B No. 57-9,053, columns 8–17, JP-A Nos. 61-20,944 and 62-135,826, and others.

The photosensitive material for heat development or dye fixing material may contain a matting agent for such purposes as prevention of adhesion, improvement of sliding property, and surface matting. Examples of the matting agent include the compounds such as silicon dioxide, polyolefin, and polymethacrylate as described in JP-A No. 61-88,256, pp.29, as well as compounds such as benzoguanamine resin beads, polycarbonate resin beads, and AS resin beads as described in JP-A Nos.63-274,944 and 63-274,952. In addition, the compounds described in the aforesaid Research Disclosure can be used. The matting agent can be added not only to the uppermost layer (protective layer) but also to an underlayer, if necessary.

Further, constituent layers of the photosensitive material for heat development or dye fixing material may contain a thermal solvent, a defoaming agent, an antibacterial/mildewproofing agent, colloidal silica, and so on. Specific examples of these additives are described in JP-A No. 61-88,256, pp.26–32, JP-A No. 3-11,338, JP-B No. 2-51,496, and others.

An image formation accelerating agent can be used in the photosensitive material for heat development and/or dye fixing material. The functions of the image formation accelerating agent include the acceleration of an oxidation/reduction reaction between a silver salt oxidizing agent and a reducing agent, the acceleration of the dye formation, dye decomposition, or release of a diffusive dye from a dye-releasable substance, and the acceleration of the dye movement from the photosensitive material for heat development to the dye fixing material. From the viewpoint of physicochemical functions, the image formation accelerating agents are classified into a base or base precursor, a nucleophilic compound, an organic solvent having a high boiling point (oil), a thermal solvent, a surfactant, a compound capable of interacting with silver or silver ions, and others. However, since these substances ordinarily have a plurality of functions, these substances usually exhibit combinations of the above-mentioned functions. The details are described in U.S. Pat. Nos. 4,678,739, columns 38–40.

Examples of the base precursor include a salt made from an organic acid and a base and capable of decarboxylation by heat and a compound capable of releasing an amine by an intramolecular nucleophilic substitution reaction, a Lossen rearrangement, or a Bechmann rearrangement. Examples of these compounds are described in U.S. Pat. Nos. 4,514,493 and 4,657,848.

In the system in which heat development and transfer of dyes are performed simultaneously in the presence of a small amount of water, it is preferable that a base and/or a base precursor is incorporated in a dye fixing material from the standpoint of enhancing the storability of the photosensitive material for heat development.

In addition, also usable as a base precursor are a combination of a barely soluble metal compound and a compound capable of reacting with the metal ions constituting the barely soluble metal compound to form a complex (hereinafter referred to a complex forming compound) as described in European Patent No.210,660 and U.S. Pat. No. 4,740,445 and a compound which generates a base by electrolysis as described in JP-A No. 61-232,451. In particular, the former type is effective. As described in the patent cited above, it is advantageous that the barely soluble metal compound and the complex forming compound be contained separately in a photosensitive material for heat development and in a dye fixing element.

In the present invention, a variety of development stoppers can be used in the photosensitive material for heat development and/or dye fixing material in order to obtain images of constant quality always independent of the variation in the processing temperature and processing time when development is performed.

The development stopper as written here refers to a compound which terminates the development by rapidly neutralizing or reacting with the base to decrease the base concentration in the film or a compound which inhibits the development by interacting with silver or a silver salt, after a proper stage of development is achieved. Specific examples of the stopper include an acid precursor which release an acid upon heating, an electrophilic compound which causes a substitution reaction with a base present upon heating, a nitrogen-containing heterocyclic compound, and a mercapto compound or a precursor thereof. Details of these compounds are described in JP-A No.62-253,159, pp.31–32.

In the present invention, a support for the photosensitive material for heat development or dye fixing material needs to be able to withstand the processing temperature. Generally, examples of the support are supports for use in photography such as paper, a synthetic polymer (film), and the like, as described in "Fundamentals of Photographic Engineering—Silver Salt Photography Section", pp.223–240, edited by Photographic Society of Japan, Corona Co., Ltd., 1979. Specific examples of the support include polyethylene terephthalate, polyethylene naphthalate, polycarbonate, polyvinyl chloride, polystyrene, polypropylene, polyimide, and cellulose (e.g., triacetylcellulose) as well as those materials which are prepared by incorporating a pigment such as titanium oxide into the foregoing substances. Additional examples of the support include film-process synthetic paper made from polypropylene or the like, mix-milled paper made from synthetic resin pulp such as polyethylene and natural pulp, Yankee paper, baryta paper, coated paper (cast-coated paper in particular), metals, clothes, glass, and so on.

The support may be composed of a single material, or otherwise it may be a material whose one side or both sides are coated or laminated with a synthetic polymer such as polyethylene. If necessary, the layer to be laminated may contain a pigment, such as titanium oxide, ultramarine blue, and carbon black, or a dye.

Other supports, which can be used in the present invention, include those described in, e.g., JP-A Nos.62-253,159, pp.29–31,1-161,236, pp.14–17, 63-316,848, 2-22,651, and 3-56,955, and U.S. Pat. No. 5,001,033.

The reverse side of the support may be coated with a mixture comprising a hydrophilic binder and a semiconducting metal oxide, such as alumina sol or tin oxide, or an antistatic agent such as carbon black or the like. Specifically, supports described in, for example, JP-A No. 63-220,246 and others, can be used.

Further, it is preferable to carry out a surface treatment or to apply a subbing layer to the support surface in order to improve the adhesion to the hydrophilic binder.

The photosensitive material for heat development and/or dye fixing material of the present invention may have an electrically conductive heat generating layer as a heating means for carrying out heat development and diffusive transfer of dyes. In this case, a heat generating element described in JP-A No. 61-145,544 and others can be used as the heat generating means.

The heating temperature in the heat development process is about 50 to 250° C. In particular, a temperature range of from about 60 to 180° C. is useful. The diffusive transfer of dyes may be carried out simultaneously with the heat development or may be carried out after the completion of the heat development. In the latter case, although the transfer can be carried out at a temperature ranging from the temperature of the heat development to room temperature, particularly preferred temperature range is between 500° C. and a temperature which is about 100° C. below the temperature of the heat development.

Although the transfer of dyes can be made by heat alone, a solvent may be used in order to accelerate the transfer of dyes. Also useful is a method in which development and transfer are carried out simultaneously or consecutively by heating in the presence of a small amount of a solvent (water in particular) as described in U.S. Pat. Nos. 4,704,345 and 4,740,445, JP-A No. 61-238,056, and others. In this method, the heating temperature is preferably between 50° C. and the boiling point of the solvent. For example, if the solvent is water, the heating temperature is preferably 50 to 100° C.

Examples of the solvent to be used for the acceleration of development and/or diffusive transfer of dyes include water, a basic aqueous solution containing an inorganic salt of an alkali metal salt or an organic base (the base for this purpose is selected from the bases listed in the explanation of image formation accelerating agents), a solvent having a low boiling point, and a mixture of the solvent having a low boiling point with water or the foregoing basic aqueous solution. The solvent may contain such substances as a surfactant, an anti-fogging agent, a compound capable of forming a complex with a barely soluble metal salt, a mildewproofing agent, and an antibacterial agent.

The solvent to be used in the heat development and diffusive transfer processes is preferably water. The water is not particularly limited, in so far as it is water generally used for such purposes. Specific examples of the water include distilled water, tap water, well water, and mineral water. In the heat developing apparatus utilizing the photosensitive material for heat development and dye fixing material of the present invention, the waste water may be discarded without being reused or may be recycled for repeated use. When recycled water is used, the water for use contains the components leached out of the materials. Further, the apparatus and water described in JP-A Nos. 63-144,354, 63-144,355, 62-38,460, 3-210,555, and others may also be used.

The solvent can be supplied to the photosensitive material for heat development or dye fixing material or to both of them. The amount of the solvent to be used is not more than the weight of the solvent corresponding to the maximum swelling of the entire coating layers.

Preferred examples of methods for supplying water to these materials include the methods described in JP-A Nos. 62-253,159, pp.5, 63-85,544, and others. Further, a solvent encapsulated into microcapsules or in the form of a hydrate may be incorporated in advance into the photosensitive material for heat development or dye fixing material or into both of them.

The temperature of water to be supplied may be in the range of from 30 to 60° C. as described, for example, in JP-A No. 63-85,544. It is useful to keep the temperature of water at 450° C. or above in order to prevent the growth of bacteria in particular in the water.

In order to accelerate the transfer of dyes, a hydrophilic thermal solvent, which is a solid at normal temperature but melted at a high temperature, may be incorporated into the photosensitive material for heat development and/or dye fixing material. Although the layer into which the thermal solvent is incorporated may be any one selected from a photosensitive silver halide emulsion layer, an intermediate layer, a protective layer, and a dye fixing layer, the dye fixing layer and/or a layer adjacent thereto is preferred.

Examples of the hydrophilic thermal solvent include urea-based compounds, pyridine-based compounds, amides, sulfonamides, imides, alcohols, oximes, and other heterocyclic compounds.

Examples of the heating method in the developing process and/or transferring process include a method in which the material is brought into contact with a heated block or plate, a method in which the material is brought into contact with such an object as a hot plate, a hot presser, a heat roller, a heat drum, a halogen lamp heater, or an infrared or far infrared lamp heater, and a method in which the material is passed through a heated atmosphere.

As to a method in which the photosensitive material for heat development and the dye fixing material are put together, the methods described in JP-A Nos. 62-253,159 and 61-147,244, pp.27 can be employed.

EXAMPLES

Example 1

An image receiving element R101 having a construction as shown in Tables 1 and 2 was prepared.

TABLE 1

Construction of image receiving element R101

| Layer number | Components | Coating Weight (mg/m$^2$) |
|---|---|---|
| The sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventative agent (1) | 7 |
| | Stain-preventative agent (2) | 12 |
| | Matting agent | 7 |
| The fifth layer | Gelatin | 250 |
| | Water-soluble polymer (1) | 25 |
| | Anionic surfactant (3) | 9 |
| | Hardener (1) | 185 |
| The fourth layer | Mordant (1) | 1850 |
| | Water-soluble polymer (2) | 260 |
| | Water-soluble polymer (4) | 1400 |
| | Latex dispersion (1) | 600 |
| | Anionic surfactant (3) | 25 |
| | Nonionic surfactant (1) | 18 |
| | Guanidine picolinate | 2550 |
| | Sodium quinolinate | 350 |
| The third layer | Gelatin | 370 |
| | Mordant (1) | 300 |
| | Anionic surfactant (3) | 12 |
| The second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | Organic solvent having a high boiling point (1) | 700 |
| | Fluorescent brightener (1) | 30 |
| | Stain-preventative agent (3) | 32 |
| | Guanidine picolinate | 360 |
| | Potassium quinolinate | 45 |
| The first layer | Gelatin | 280 |
| | Water-soluble polymer (1) | 12 |
| | Anionic surfactant (1) | 14 |
| | Sodium metaborate | 35 |
| | Hardener (1) | 185 |
| Support (1) | polyethylene-laminated paper (having a thickness of 215 μm) | |

Coating weight of latex dispersion is based on solid components of the latex

TABLE 2

Construction of support

| Name of Layer | Composition | | Film thickness (μm) |
|---|---|---|---|
| Subbing layer | Gelatin | | 0.1 |
| PE layer (glossy) on surface side | Low-density polyethylene (having a density of 0.923): | 90.2 parts | 36.0 |
| | Surface-treated titanium dioxide: | 9.8 parts | |
| | Ultramarine blue: | 0.001 parts | |
| Pulp layer | Fine paper | | 152.0 |
| | (LBKP/NBSP = 6/4, having a density of 1.053) | | 152.0 |
| PE layer (mat) on reverse side | High density polyethylene (having a density of 0.955) | | 27.0 |
| Subbing layer | Styrene/acrylate copolymer | | 0.1 |
| on reverse | Colloidal silica | | |

TABLE 2-continued

| Construction of support | | |
|---|---|---|
| Name of Layer | Composition | Film thickness (μm) |
| side | Sodium polystyrenesulfonate | 215.2 |

anionic surfactant (1)

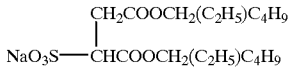

anionic surfactant (2)

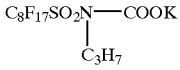

anionic surfactant (3)

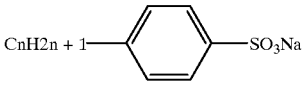

$n = 12.6$ anionic surfactant (4)

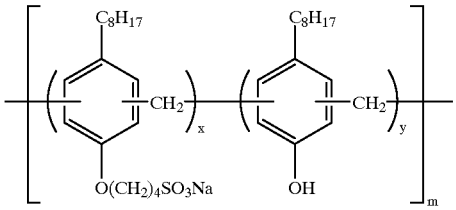

$x:y = 4:6$ $m = 6.8$ nonionic surfactant (1)

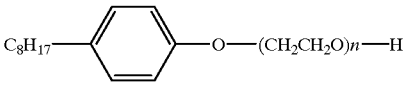

$n = 85$ amphoteric surfactant (1)

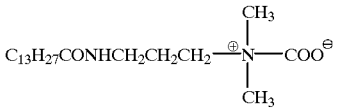

fluorescent brightener(1)

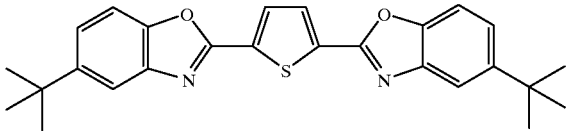

mordant (1)

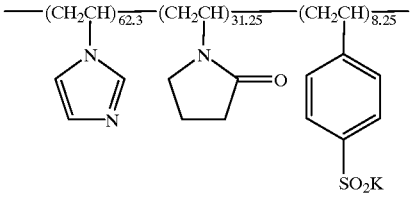

stain-preventive agent (1)

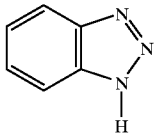

stain-preventive agent (2)

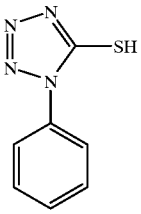

stain-preventive agent (3)

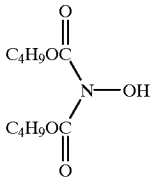

organic solvent having a high boiling point (1) $C_{24}H_{44}Cl_6$ (Enpara 40 manufactured by Ajinomoto Co., Inc.)

water-soluble polymer (1)

Sumikagel L5-H (manufactured by Sumitomo Chemical Co., Ltd.)

water-soluble polymer (2)

dextran (having a molecular weight of 70,000)

water-soluble polymer (3)

copper carrageenan (manufactured by Taito Co., Ltd.)

water-soluble polymer (4)

MP Polymer MP-102 (manufactured by Kuraray Co., Ltd.)

latex dispersion (1)

LX-438 (manufacture by Nippon Zeon Co., Ltd.

matting agent (1)

SYLOID 79 (manufactured by Fuji Bayson Co., Ltd.)

hardener (1)

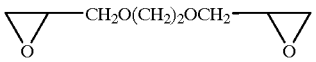

Next, photosensitive elements were prepared in the following way.

First, photosensitive silver halide emulsions (1) to (3) were prepared in the following way. Photosensitive silver halide emulsion (1) [for use in red-sensitive layers]

To an aqueous solution which was well stirred and composed of components shown in Table 3, the liquid (I) composed of components shown in Table 4 was added at a constant flow rate over a period of 9 minutes, and the liquid (II) composed of components shown in Table 4 was also added at a constant flow rate over a period of 9 minutes and 10 seconds starting at 10 seconds before the start of the addition of the liquid (I). At 36 minutes after the addition, the liquid (III) composed of components shown in Table 4 was added at a constant flow rate over a period of 24 minutes, and the liquid (IV) composed of components shown in Table 4 was also added simultaneously with the liquid (III) at a constant flow rate over a period of 25 minutes.

After carrying out water-washing and desalting operations according to ordinary methods (the desalting operation was performed by using a precipitant a at a pH value of 4.0), 880 g of lime-treated ossein gelatin was added and the pH of the resulting liquid was adjusted to 6.0. Then, 12.8 g of a ribonucleic acid decomposition product and 32 mg of trimethylthiourea were added and the resulting liquid was subjected to an optimal chemical sensitization at 60° C. for 71 minutes. After that, 2.6 g of 4-hydroxy-6-methyl-1,3,3a,7-tetrazaindene, 3.2 g of a dye (a), 5.1 g of KBr, and 2.6 g of a stabilizer, described later, were added successively. After the completion of the addition, the resulting liquid was cooled. In this way, 28.1 kg of a silver chlorobromide emulsion composed of monodispersed cubic particles having an average particle size of 0.35 $\mu$m was obtained.

TABLE 3

| Composition | |
|---|---|
| $H_2O$ | 26300 cc |
| Lime-treated gelatin | 800 g |
| KBr | 12 g |
| NaCl | 80 g |
| Compound (a) | 1.2 g |
| Temperature | 53° C. |

TABLE 4

| | Liquid (I) | Liquid (II) | Liquid (III) | Liquid (IV) |
|---|---|---|---|---|
| $AgNO_3$ | 1200 g | None | 2800 g | None |
| KBr | None | 546 g | None | 1766 g |
| NaC1 | None | 144 g | None | 96 g |
| $K_2lrCl_6$ | None | 3.6 mg | None | None |
| Total | 6.5 liters | 6.5 liters | 10 liters | 10 liters |

TABLE 4-continued

| | Liquid (I) | Liquid (II) | Liquid (III) | Liquid (IV) |
|---|---|---|---|---|
| amount | after the addition of water | after the addition of water | after the addition of water | after the addition of water |

compound (a)

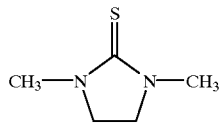

dye (a)

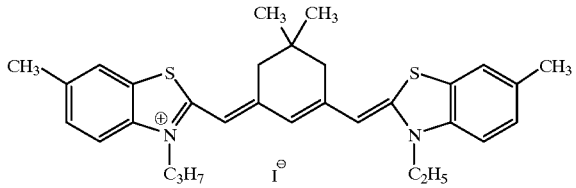

precipitant a

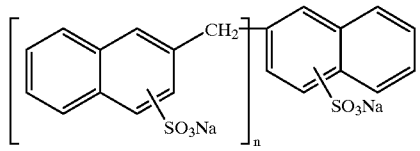

Photosensitive silver halide emulsion (2) [for use in green-sensitive layers]

To an aqueous solution which was well stirred and composed of components shown in Table 5, there were added the liquid (I) composed of components shown in Table 6 and the liquid (II) composed of components shown in Table 6 simultaneously at a constant flow rate over a period of 9 minutes. At 5 minutes after the completion of the addition, the liquid (III) composed of components shown in Table 6 and the liquid (IV) composed of components shown in Table 6 were added simultaneously at a constant flow rate over a period of 32 minutes. Further, after the completion of the addition of the liquids (III) and (IV), 60 mL of a solution of dyes in methanol (containing 360 mg of a dye (b-1) and 73.4 mg of a dye (b-2)) was added at one time.

After carrying out water-washing and desalting operations according to ordinary methods (desalting operation was performed by using a precipitant a at a pH value of 4.0), 22 g of lime-treated ossein gelatin was added and the pH of the resulting liquid was adjusted to 6.0 and the pAg was adjusted to 7.6. Then, 1.8 mg of sodium thiosulfate and 180 mg of 4-hydroxy-6-methyl-1,3,3a,7-tetrazaindene were added and the resulting liquid was subjected to an optimal chemical sensitization at 60° C. After that, 90 mg of an anti-fogging agent (1) was added and the resulting liquid was cooled. In this way, 635 g of a silver chlorobromide emulsion composed of monodispersed cubic particles having an average particle size of 0.30 $\mu$m was obtained.

TABLE 5

| Composition | |
|---|---|
| $H_2O$ | 600 cc |
| Lime-treated gelatin | 20 g |
| KBr | 0.3 g |
| NaCl | 2 g |
| Compound (a) | 0.03 g |
| Sulfuric acid (1N) | 16 cc |
| Temperature | 46° C. |

TABLE 6

| | Liquid (I) | Liquid (II) | Liquid (III) | Liquid (IV) |
|---|---|---|---|---|
| $AgNO_3$ | 10.0 g | None | 90.0 g | None |
| KBr | None | 3.50 g | None | 57.1 g |
| NaCl | None | 1.72 g | None | 3.13 g |
| $K_2IrCl_6$ | None | None | None | 0.03 mg |
| Total amount | 120 ml after the addition of water | 131 ml after the addition of water | 280 ml after the addition of water | 289 ml after the addition of water |

dye (b-1)

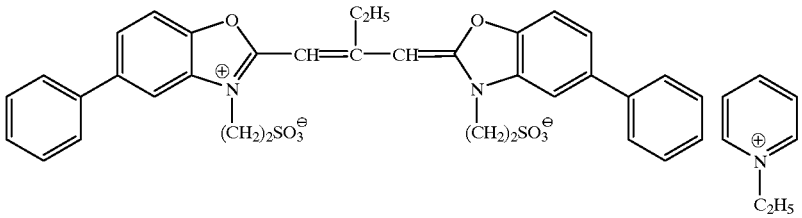

(b-1)

dye (b-2)

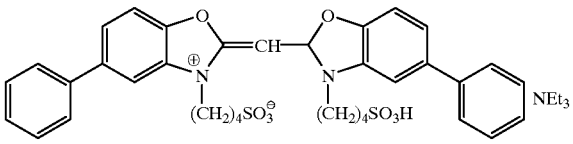

precipitant a

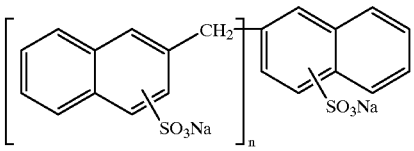

anti-fogging agent (1)

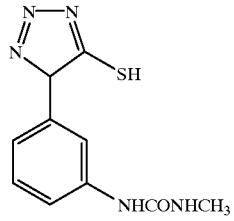

Photosensitive silver halide emulsion (3) [for use in blue-sensitive layers]

To an aqueous solution which was well stirred and composed of components shown in Table 7, there were added the liquid (I) composed of components shown in Table 8 and the liquid (II) composed of components shown in Table 8, each over a period of 30 minutes, such that the addition of the liquid (I) started at 10 seconds after the start of the addition of the liquid (II). At 2 minutes after the completion of the addition of the liquid (I), the liquid (V) composed of components shown in Table 8 was added. Further, at 5 minutes after the completion of the addition of the liquid (II), the liquid (IV) composed of components shown in Table 8 was added. Furthermore, at 10 seconds after the start of the addition of the liquid (IV), the liquid (III) composed of components shown in Table 8 was added. The liquid (III) was added over a period of 27 minutes and 50 seconds, while the liquid (IV) was added over a period of 28 minutes.

After carrying out water-washing and desalting operations according to ordinary methods (the desalting operation was performed by using a precipitant b at a pH value of 3.9), 1,230 g of lime-treated ossein gelatin and 2.8 mg of a compound (b) were added and the pH of the resulting liquid was adjusted to 6.1 and the pAg was adjusted to 8.4. Then, 24.9 mg of sodium thiosulfate was added and the resulting liquid was subjected to an optimal chemical sensitization at 60° C. After that, 13.1 g of a dye (c) and 118 mL of a compound (c) were added successively and the resulting liquid was cooled. In this way, 30,700 g of a silver halide emulsion composed of potato-shaped halide particles having an average particle size of 0.53 $\mu$m was obtained.

TABLE 7

| Composition | |
|---|---|
| $H_2O$ | 29200 cc |
| Lime-treated gelatin | 1582 g |
| KBr | 127 g |
| Compound (a) | 0.66 g |
| Temperature | 72° C. |

TABLE 8

| | Liquid (I) | Liquid (II) | Liquid (III) | Liquid (IV) | Liquid (V) |
|---|---|---|---|---|---|
| $AgNO_3$ | 939 g | None | 3461 g | None | None |
| KBr | None | 572 g | None | 2464 g | None |
| Kl | None | None | None | None | 22 g |
| Total amount | 6690 ml after the addition of water | 6680 ml after the addition of water | 9700 ml after the addition of water | 9740 ml after the addition of water | 4400 ml after the addition of water |

precipitant b

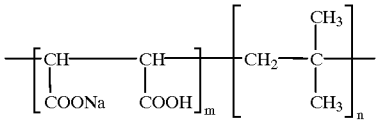

m + n = 1 dye (c)

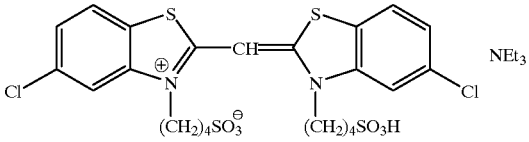

compound (c)

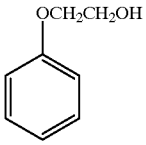

compound (b)

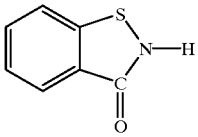

Next, dispersions of hydrophobic additives in gelatin were prepared.

Dispersions in gelatin comprising gelatin and a yellow coupler (i), a magenta coupler (i), and a cyan coupler (i) as well as developing agents (i) to (iii), having respective structural formulae given below, were each prepared according to the formulations shown in Table 9. The procedure for preparing each dispersion comprised the steps of melting oil phase components at about 70° C. to form a homogeneous solution, blending this solution with aqueous phase components kept at about 60° C., and dispersing the blend by stirring in a homogenizer at 10,000 rpm for 10 minutes. After that, water was added and the resulting mixture was stirred. In this way, a homogeneous dispersion was obtained.

cyan coupler (i)

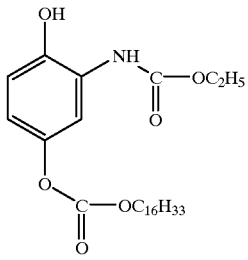

magenta coupler (i)

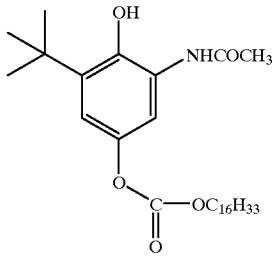

yellow coupler (i)

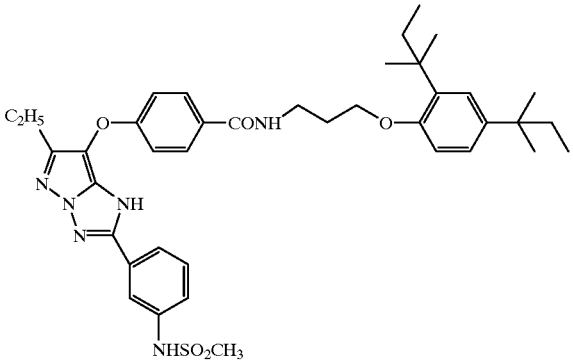

developing agent (i)

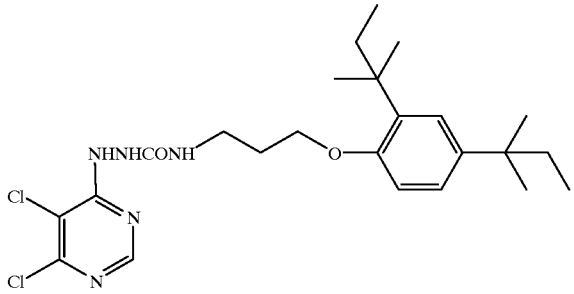

developing agent (ii)

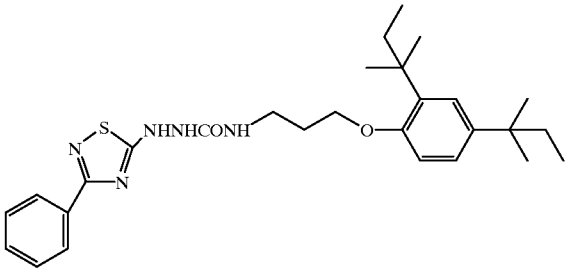

developing agent (iii)

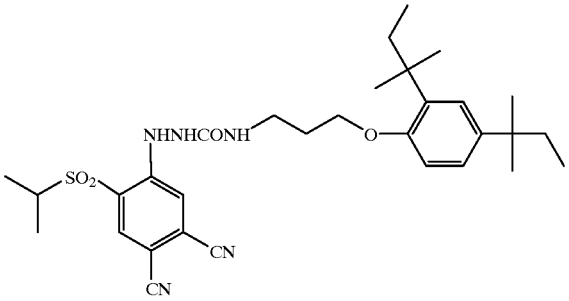

TABLE 9

| | Compositions of dispersions | | |
|---|---|---|---|
| | Yellow | Magenta | Cyan |
| Oil phase | | | |
| Cyan coupler (1) | None | None | 7.0 g |
| Magenta coupler (1) | None | 7.0 g | None |
| Yellow coupler (1) | 7.0 g | None | None |
| Developing agent (1) | None | None | 5.6 g |
| Developing agent (2) | None | 5.6 g | None |
| Developing agent (3) | 5.6 g | None | None |
| Anti-fogging agent (5) | 0.25 g | None | None |
| Anti-fogging agent (2) | None | 0.25 g | 0.25 g |
| Solvent having a high boiling point (4) | 7.4 g | 7.4 g | 7.4 g |
| Ethyl acetate | 15 cc | 15 cc | 15 cc |
| Aqueous phase | | | |
| Lime-treated gelatin | 10.0 g | 10.0 g | 10.0 g |
| Calcium nitrate | 0.1 g | 0.1 g | 0.1 g |
| Surfactant (1) | 0.7 g | 0.7 g | 0.7 g |
| Water | 110 cc | 110 cc | 110 cc |

TABLE 9-continued

| | Compositions of dispersions | | |
|---|---|---|---|
| | Yellow | Magenta | Cyan |
| Make-up water | 110 cc | 110 cc | 110 cc |
| Antiseptic (1) | 0.04 g | 0.04 g | 0.04 g |

A dispersion of an anti-fogging agent (iv) and a reducing agent (i) in gelatin was prepared according to the formulation shown in Table 10. The procedure for preparing the dispersion comprised the steps of melting oil phase components at about 60° C. to form a homogeneous solution, blending this solution with aqueous phase components kept at about 60° C., and dispersing the blend with stirring in a homogenizer at 10,000 rpm for 10 minutes. In this way, a homogeneous dispersion was obtained.

TABLE 10

| | Composition of dispersion |
|---|---|
| Oil phase | |
| Anti-fogging agent (4) | 0.16 g |
| Reducing agent (1) | 1.3 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Aqueous phase | |
| Acid-treated gelatin | 10.0 g |
| Antiseptic (1) | 0.004 g |
| Calcium nitrate | 0.1 g |
| Water | 35.0 ml |
| Make-up water | 104.4 ml |

A dispersion of a polymer latex (a) was prepared according to the formulation shown in Table 11. The procedure for preparing the dispersion comprised adding an anionic surfactant (vi) over a period of 10 minutes to a stirred blend of a polymer latex (a), a surfactant (v), and water in amounts shown, respectively, in the table 11 to obtain a homogeneous dispersion. The salt concentration of the dispersion thus obtained was reduced to one ninth by repeating condensation by means of ultrafiltration using ultrafiltration modules (ACV-3050 manufactured by Asahi Chemical Industry Co., Ltd.) and subsequent dilution with water.

TABLE 11

| | Composition of dispersion |
|---|---|
| Aqueous polymer latex a (having a solid content of 13%) | 108 ml |
| Surfactant (5) | 20 g |
| Surfactant (6) | 600 ml |
| Water | 1232 ml |

A dispersion of zinc hydroxide in gelatin was prepared according to the formulation shown in Table 12. The procedure for preparing the dispersion comprised the steps of blending/dissolving the components and then dispersing the blend for 30 minutes by means of a mill using glass beads having an average particle diameter of 0.75 mm. After the separation of the glass beads, a homogeneous dispersion was obtained.

TABLE 12

| | Composition of dispersion |
|---|---|
| Zinc hydroxide | 15.9 g |
| Carboxymethyl cellulose | 0.7 g |
| Sodium polyacrylate | 0.07 g |
| Lime-treated gelatin | 4.2 g |
| Water | 100 ml |
| Antiseptic (2) | 0.4 g |

Next, the preparation of a dispersion of a matting agent in gelatin for use in a protective layer is described. A solution comprising PMMA dissolved in methylene chloride was added together with a small amount of a surfactant into gelatin and the resulting mixture was dispersed by stirring at a high speed. The methylene chloride was then removed by means of a solvent removing apparatus using a reduced pressure. In this way, a homogeneous dispersion having an average particle size of 4.3 $\mu$m was obtained.

anti-fogging agent (v)

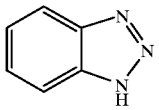

anti-fogging agent (ii)

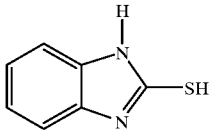

organic solvent having a high boiling point (iv)

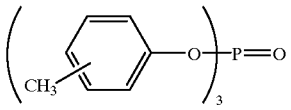

antiseptic (i)

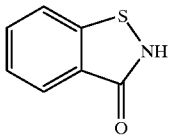

surfactant (i)

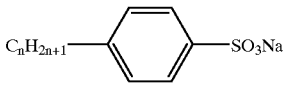

$n = 12.6$ anti-fogging agent (iv)

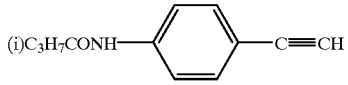

surfactant (iv)

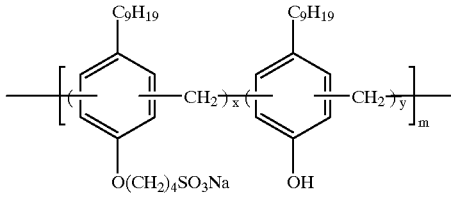

$x:y = 4:6$
$m = 6.8$ organic solvent having a high boiling point (ii)

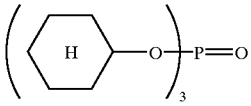

antiseptic (i)

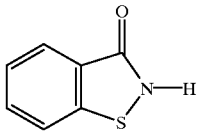

organic solvent having a high boiling point $C_{24}H_{44}Cl_6$ (Enpara 40 manufactured by Ajinomoto Co., Inc.)

reducing agent (i)

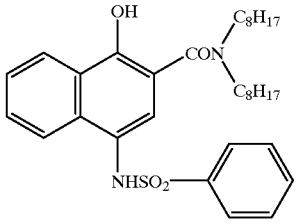

polymer latex (a)

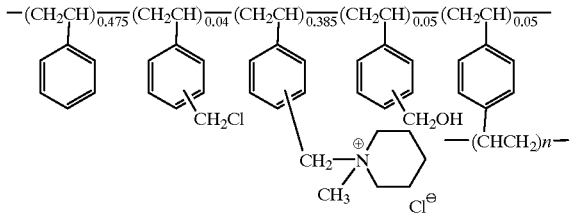

surfactant (v)

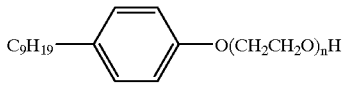

$n = 50$ surfactant (vi)

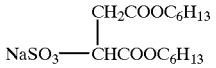

antiseptic (ii)

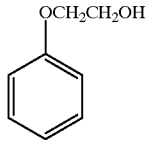

By using the components prepared above, a photosensitive element 101 shown in Table 13 was prepared.

TABLE 13

Main components of photosensitive element 101

| Layer number | Name of layer | Components | Coating weight ($mg/m^2$) |
|---|---|---|---|
| The seventh layer | Protective layer | Acid-treated gelatin | 387 |
| | | Matting agent (PMMA resin) | 17 |
| | | Surfactant (2) | 6 |
| | | Surfactant (3) | 20 |
| | | Polymer latex a dispersion | 10 |
| The sixth layer | Intermediate layer | Lime-treated gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 57 |
| | | Zinc hydroxide | 558 |
| | | Calcium nitrate | 6 |
| The fifth layer | Blue-sensitive layer | Lime-treated gelatin | 587 |
| | | Photosensitive silver halide emulsion (3) | 399 |
| | | Yellow coupler (3) | 410 |
| | | Developing agent (3) | 328 |
| | | Anti-fogging agent (2) | 15 |
| | | Solvent having a high boiling point (4) | 433 |
| | | Surfactant (1) | 12 |
| | | water-soluble polymer (1) | 40 |
| The fourth layer | Intermediate layer | Lime-treated gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 4 |
| | | Zinc hydroxide | 341 |
| | | Calcium nitrate | 8 |
| The third layer | Green-sensitive layer | Lime-treated gelatin | 452 |
| | | Photosensitive silver halide emulsion (2) | 234 |
| | | Magenta coupler (2) | 420 |
| | | Developing agent (2) | 336 |
| | | Anti-fogging agent (2) | 15 |
| | | Solvent having a high boiling point (4) | 444 |
| | | Surfactant (1) | 12 |
| | | Water-soluble polymer (1) | 10 |
| The second layer | Intermediate layer | Lime-treated gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 10 |
| | | Calcium sulfate | 8 |
| The first layer | Red-sensitive layer | Lime-treated gelatin | 373 |
| | | Photosensitive silver halide emulsion (1) | 160 |
| | | Cyan coupler (1) | 390 |
| | | Developing agent (1) | 312 |
| | | Anti-fogging agent (2) | 14 |
| | | Solvent having a high boiling point (4) | 412 |
| | | Surfactant (1) | 11 |
| | | Water-soluble polymer (2) | 25 |
| | | Hardener (1) | 45 |

Support (20 μm-thick PET which is vacuum-deposited with aluminum and thereafter coated with gelatin as a subbing layer)

surfactant (ii)

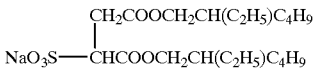

surfactant (iii)

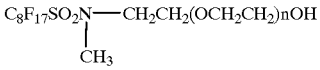

water-soluble polymer (i)

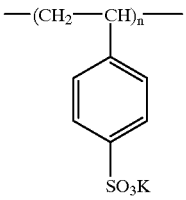

intrinsic viscosity [η]=1.6 (0.1N NaCl, 30° C.) molecular weight=1,000,000 water-soluble polymer (ii)

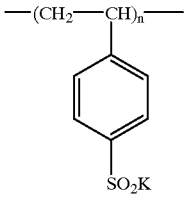

intrinsic viscosity [η]=0.8 (0.1N NaCl, 30° C.) molecular weight=400,000 hardener (i)

$CH_2=CHSO_2CH_2SO_2CH=CH_2$

Next, a photosensitive material 102 for use in comparison was prepared by eliminating the reducing agent (i) serving as a color-mixing preventive agent from the intermediate layers, i.e., the fourth and sixth layers, of the formulation. Further, photosensitive materials were prepared in the same manner except that a compound represented by the general formula (III) or (IV) was used in place of the reducing agent (i) in the intermediate layers, i.e., the fourth and sixth layers, in the same molar amounts.

From the photosensitive materials prepared above, images were produced at 80° C. using a Pictrostat 330 manufactured by Fuji Photo Film Co., Ltd. and evaluations were conducted with respect to photographic characteristics and color muddiness. The photographic characteristics were expressed in Dmin (minimum density) and Dmax (maximum density) after a development time of 15 seconds and the color muddiness was obtained by the density of yellow or cyan coloration at a magenta coloration density of 1.5.

The results are shown in Table 14.

As can be seen from Table 14, the photosensitive materials of the present invention (104 to 113) exhibit good photographic characteristics (i.e., large Dmax and small Dmin) in a short development time. In addition, it was found that the color muddiness in these photosensitive materials was remarkably improved beyond expectation.

Example 2

Photosensitive materials were prepared in the same manner as that employed in Example 1, except that the developing agents and couplers in the first, third, and fifth layers were replaced, respectively, with the following DRR compounds in the same molar amounts. These photosensitive materials were subjected to the same treatments as those in Example 1.

yellow dye-releasable compound

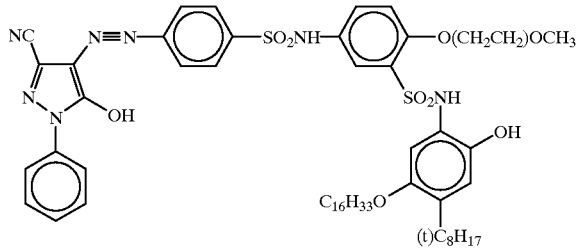

TABLE 14

| Photo-sensitive material | Compound according to the present invention (I, II) | Compound according to the present invention (III, IV) | Photographic characteristics Dmin/Dmax DB | DG | DR | Color mixing DB | DR | |
|---|---|---|---|---|---|---|---|---|
| 101 | — | Reducing agent (1) | 0.09/1.52 | 0.12/1.66 | 0.09/1.72 | 0.21 | 0.29 | Comparative Example |
| 102 | D-4 | None | 0.16/2.11 | 0.22/2.38 | 0.21/2.48 | 0.58 | 0.62 | Comparative Example |
| 103 | D-4 | Reducing agent (1) | 0.21/2.04 | 0.33/2.35 | 0.28/2.41 | 0.31 | 0.39 | Comparative Example |
| 104 | D-4 | SCC-17 | 0.11/2.13 | 0.13/2.41 | 0.10/2.44 | 0.15 | 0.18 | Example |
| 105 | D-22 | SCC-17 | 0.12/2.18 | 0.13/2.37 | 0.11/2.50 | 0.16 | 0.18 | Example |
| 106 | D-31 | SCC-17 | 0.12/2.19 | 0.13/2.34 | 0.12/2.49 | 0.11 | 0.15 | Example |
| 107 | D-34 | SCC-17 | 0.11/2.16 | 0.12/2.33 | 0.12/2.44 | 0.13 | 0.16 | Example |
| 108 | D-39 | SCC-17 | 0.12/2.18 | 0.11/2.35 | 0.12/2.41 | 0.14 | 0.16 | Example |
| 109 | D-49 | SCC-14 | 0.11/2.22 | 0.12/2.34 | 0.12/2.42 | 0.11 | 0.15 | Example |
| 110 | D-49 | SCC-20 | 0.11/2.22 | 0.12/2.34 | 0.12/2.42 | 0.12 | 0.14 | Example |
| 111 | D-49 | SCC-26 | 0.11/2.22 | 0.12/2.34 | 0.12/2.42 | 0.14 | 0.14 | Example |
| 112 | D-4 | SCC-32 | 0.11/2.22 | 0.12/2.34 | 0.12/2.42 | 0.13 | 0.14 | Example |
| 113 | D-4 | SCC-38 | 0.11/2.22 | 0.12/2.34 | 0.12/2.42 | 0.13 | 0.15 | Example |

magenta dye-releasable compound

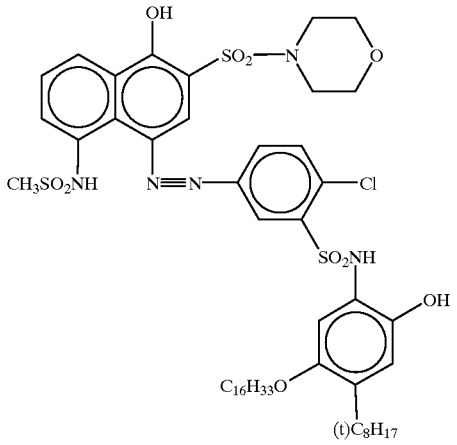

cyan dye-releasable compound

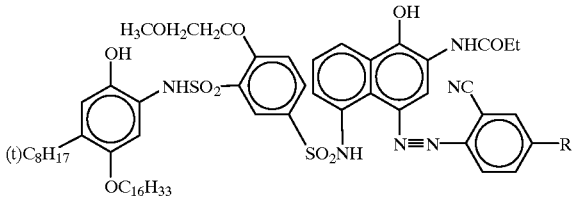

R=$NO_2$, R=$SO_2CH_3$ mixture at 4/6 (mol/mol)

The results are shown in Table 15.

TABLE 15

| Photo-sensitive material | Compound according to the present invention (I, II) | Compound according to the present invention (III, IV) | Photographic characteristics Dmin/Dmax DB | DG | DR | Color mixing DB | DR | |
|---|---|---|---|---|---|---|---|---|
| 201 | — | Reducing agent (1) | 0.09/1.52 | 0.12/1.66 | 0.09/1.72 | 0.21 | 0.29 | Comparative Example |
| 202 | D-39 | None | 0.16/2.11 | 0.22/2.38 | 0.21/2.48 | 0.58 | 0.62 | Comparative Example |
| 203 | D-39 | Reducing agent (1) | 0.21/2.04 | 0.33/2.35 | 0.28/2.41 | 0.31 | 0.39 | Comparative Example |
| 204 | D-39 | SCC-17 | 0.11/2.13 | 0.13/2.41 | 0.10/2.44 | 0.15 | 0.18 | Example |
| 205 | D-4 | SCC-17 | 0.12/2.18 | 0.13/2.37 | 0.11/2.50 | 0.16 | 0.18 | Example |
| 206 | D-55 | SCC-17 | 0.12/2.19 | 0.13/2.34 | 0.12/2.49 | 0.11 | 0.15 | Example |
| 207 | D-56 | SCC-17 | 0.11/2.16 | 0.12/2.33 | 0.12/2.44 | 0.13 | 0.16 | Example |
| 208 | D-60 | SCC-17 | 0.12/2.18 | 0.11/2.35 | 0.12/2.41 | 0.14 | 0.16 | Example |
| 209 | D-9 | SCC-14 | 0.11/2.22 | 0.12/2.34 | 0.12/2.42 | 0.11 | 0.15 | Example |
| 210 | D-3 | SCC-20 | 0.11/2.22 | 0.12/2.34 | 0.12/2.42 | 0.12 | 0.14 | Example |
| 211 | D-11 | SCC-26 | 0.11/2.22 | 0.12/2.34 | 0.12/2.42 | 0.14 | 0.14 | Example |
| 212 | D-22 | SCC-32 | 0.11/2.22 | 0.12/2.34 | 0.12/2.42 | 0.13 | 0.14 | Example |
| 213 | D-31 | SCC-38 | 0.11/2.22 | 0.12/2.34 | 0.12/2.42 | 0.13 | 0.15 | Example |

As can be seen from Table 15, it was found that the employment of the dye-releasable system also enabled the photosensitive materials of the present invention (204 to 213) to exhibit good photographic characteristics as in Example 1.

In short, the present invention makes it possible to provide a color photographic photosensitive material for use in heat development which produces good discrimination and little color muddiness.

What is claimed is:

1. A heat developable color photographic photosensitive material, said material comprising a support having thereon a photosensitive silver halide, a binder, a dye-donating compound, a compound represented by the general formula (I) or (II), and a compound represented by the general formula (III) or (IV):

General formula (I)

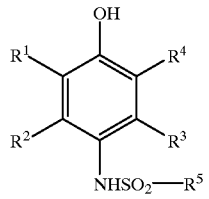

General formula (II)

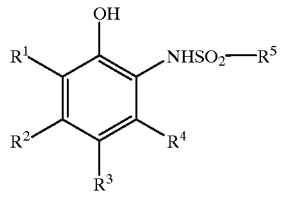

wherein $R^1$ to $R^4$ each represent a hydrogen atom, a halogen atom, a cyano group, or a group selected from the group consisting of an alkyl group, an aryl group, a heterocyclic group, an alkoxy group, an aryloxy group, an alkylthio group, an arylthio group, an alkylcarbonyl group, an arylcarbonyl group, an alkylsulfonyl group, an arylsulfonyl group, an alkylcarbonamide group, an arylcarbonamide group, an alkylsulfonamide group, an arylsulfonamide group, an alkylcarbonyloxy group, an arylcarbonyloxy group, a carbamoyl group, an alkylcarbamoyl group, an arylcarbamoyl group, an alkoxycarbonyl group, an aryloxycarbonyl group, a sulfamoyl group, an alkylsulfamoyl group, an arylsulfamoyl group, an ureido group, and a urethane group, with the proviso that these groups have 4 or less carbon atoms or an I/O value of 1 or more and further with the proviso that if $R^1$ and $R^2$ as well as $R^3$ and $R^4$ are each a group other than a hydrogen atom, $R^1$ and $R^2$ as well as $R^3$ and $R^4$ may join together to form respective rings within the above-described range of I/O values; $R^5$ represents a group selected from the group consisting of an alkyl group, an aryl group a heterocyclic ring group, an alkylamino group, an arylamino group, and a heterocyclic amino group;

General formula (III)

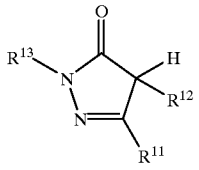

wherein $R^{11}$ represents a hydrogen atom or a substituent group; $R^{12}$ represents a group selected from the group consisting of an alkyl group, an alkenyl group, an alkynyl group, an aryl group, an alkoxycarbonyl group, an aryloxycarbonyl group, and a carbamoyl group; and $R^{13}$ represents a group selected from the group consisting of a hydrogen atom, an alkyl group, an alkenyl group, an alkynyl group, an aryl group, and a heterocyclic group;

General formula (IV)

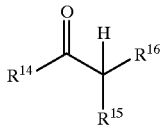

wherein $R^{14}$ represents a group selected from the group consisting of an alkyl group, an alkenyl group, an alkynyl group, an aryl group, a heterocyclic group, an alkoxy group, an aryloxy group, a heterocycloxy group, an amino group, and an anilino group; $R^{15}$ represents a group selected from the group consisting of an alkoxycarbonyl, an aryloxycarbonyl group, and a carbamyol group; and $R^{16}$ represents a group selected from the group consisting of an alkyl group, an alkenyl group, an alkynyl group and an aryl group, with the proviso that $R^{14}$ and $R^{16}$ may join together to form a ring.

2. A heat developable color photographic photosensitive material according to claim 1, wherein the compound represented by the general formula (I) or (II) is a reducing agent for silver development.

3. A heat developable color photographic photosensitive material according to claim 2, wherein $R^5$ in the general formula (I) and (II) is an aryl group represented by the following general formula (V)

General formula (V)

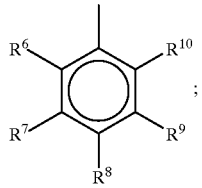

$R^1$ to $R^4$ in the general formulae (I) and (II) as well as $R^6$ to $R^{10}$ in the general formula (V) represent, respectively, a hydrogen atom, a halogen atom, a cyano group, or a substituent group having 4 or less carbon atoms or an I/O value of between 1 and 10.

4. A heat developable color photographic photosensitive material according to claim 1, wherein the amount of the compound represented by the general formula (I) or (II) is 10 to 200 mol %, based on the developing agent or dye-donating compound.

5. A heat developable color photographic photosensitive material according to claim 1, wherein the compound represented by the general formula (I) or (II) is incorporated in the photosensitive silver halide layer on the support.

6. A heat developable color photographic photosensitive material according to claim 1, wherein $R^{11}$ of the compound represented by the general formula (III) is an alkyl group, an alkoxy group, an anilino group, or a carbonamide group; $R^{12}$ is an alkyl group having 1 to 8 carbon atoms; and $R^{13}$ is an alkyl group or an aryl group.

7. A heat developable color photographic photosensitive material according to claim 1, wherein $R^{14}$ of the compound represented by the general formula (IV) is an alkyl group, an aryl group, a heterocyclic group, an alkoxy group, an aryloxy group, or an anilino group; $R^{15}$ is an alkoxycarbonyl group or a carbamoyl group; and $R^{16}$ is an alkyl group.

8. A heat developable color photographic photosensitive material according to claim 1, wherein the compound represented by the general formula (IV) is a compound represented by the following general formula (VI):

General formula (VI)

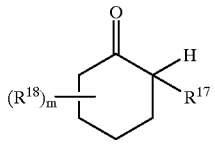

wherein $R^{17}$ is the same as $R^{15}$ in the general formula (IV); $R^{18}$ is the same as $R^{11}$ in the general formula (III); m is an integer of 0 to 8, with the proviso that $R^{17}$ is an alkoxycarbonyl group or a carbamoyl group; $R^{18}$ is a halogen atom, an alkyl group, an alkenyl group, an alkynyl group, an aryl group, a heterocyclic group, an alkoxycarbonyl group, an aryloxycarbonyl group, or a carbamoyl group; and m is preferably 0 to 2.

9. A heat developable color photographic photosensitive material according to claim 1, wherein the compound represented by the general formula (IV) is a compound represented by the following general formula (VII):

General formula (VII)

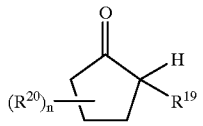

wherein $R^{19}$ is the same as $R^{15}$ in the general formula (IV); $R^{20}$ is the same as $R^{11}$ in the general formula (III); and n is an integer of 0 to 6 with the proviso that $R^{19}$ is an alkoxycarbonyl group or a carbamoyl group and; $R^{20}$ is a halogen atom, an alkyl group, an alkenyl group, an alkynyl group, an aryl group, a heterocyclic group, an alkoxycarbonyl group, an aryloxycarbonyl group, or a carbamoyl group; and n is 0 to 2.

10. A heat developable color photographic photosensitive material according to claim 1, wherein the dye-donating compound is a compound having a function to release or form a diffusive dye in accordance with a reaction in which silver ions are reduced to silver at a high temperature and wherein this type of dye-donating compound is represented by the following general formula [L1]:

$$((\mathrm{Dye})_m\text{–}\mathrm{Y})_n\text{–}\mathrm{Z} \qquad [\mathrm{L1}]$$

wherein Dye represents a dye group or a dye precursor group, or dye group or a dye precursor group having the absorption wavelength region thereof temporarily shifted in a short wavelength region; Y represents a simple bond or a linking group; Z represents a group which causes difference in the diffusivity of the compound represented by the formula $((\mathrm{Dye})_m\text{–}\mathrm{Y})_n\text{–}\mathrm{Z}$ conforming to the image-wise latent image of a photosensitive silver salt, or which releases $(\mathrm{Dye})_m\text{–}\mathrm{Y}$ and causes difference in the diffusivity of the released $(\mathrm{Dye})_m\text{–}\mathrm{Y}$ from that of $((\mathrm{Dye})_m\text{–}\mathrm{Y})_n\text{–}\mathrm{Z}$; m is an integer of 1 to 5; n is 1 or 2; and the plurality of Dyes may be the same or different if both m and n are not 1.

11. A heat developable color photographic photosensitive material according to claim 10, wherein the dye-donating compound is a coupler which has a diffusive dye as a leaving group and can release the diffusive dye but which itself is a non-diffusive compound.

12. A heat developable color photographic photosensitive material according to claim 10, wherein the dye-donating compound is a compound which can reduce a silver halide or an organic silver salt and releases a diffusive dye after reducing the silver halide or the organic silver salt and which itself is a non-diffusive compound.

13. The heat developable color photographic photosensitive material according to claim 4, wherein the amount of the compound represented by the general formula (I) or (II) is 10 to 100 mol% based on the developing agent or dye-donating compound.

14. The heat developable color photographic photosensitive material according to claim 6, wherein $R^{12}$ is a methyl group.

15. The heat developable color photographic photosensitive material according to claim 7, wherein $R^{15}$ is a carbamoyl group.

16. The heat developable color photographic photosensitive material according to claim 8, wherein $R^{17}$ is a carbamoyl group.

17. The heat developable color photographic photosensitive material according to claim 8, wherein m is 0.

18. The heat developable color photographic photosensitive material according to claim 9, wherein $R^{19}$ is a carbamoyl group.

19. The heat developable color photographic photosensitive material according to claim 9, wherein n is 0.

* * * * *